US010940976B2

(12) United States Patent
Goddard

(10) Patent No.: US 10,940,976 B2
(45) Date of Patent: Mar. 9, 2021

(54) CONTAINER

(71) Applicant: Uniseg Products Pty Ltd, Southern River (AU)

(72) Inventor: Earl Fenton Goddard, Southern River (AU)

(73) Assignee: UNISEG PRODUCTS PTY LTD, Southern River Wa (AU)

( * ) Notice: Subject to any disclaimer, the term of this patent is extended or adjusted under 35 U.S.C. 154(b) by 163 days.

(21) Appl. No.: 15/524,839

(22) PCT Filed: Nov. 5, 2015

(86) PCT No.: PCT/AU2015/000673
§ 371 (c)(1),
(2) Date: May 5, 2017

(87) PCT Pub. No.: WO2016/070235
PCT Pub. Date: May 12, 2016

(65) Prior Publication Data

US 2018/0312295 A1 Nov. 1, 2018

(30) Foreign Application Priority Data

Nov. 6, 2014 (AU) ..... 2014904472

(51) Int. Cl.
*B65D 19/18* (2006.01)
*B65D 77/06* (2006.01)
(Continued)

(52) U.S. Cl.
CPC ..... *B65D 19/18* (2013.01); *B65D 45/025* (2013.01); *B65D 77/061* (2013.01);
(Continued)

(58) Field of Classification Search
CPC .... B65D 19/18; B65D 45/025; B65D 77/061; B65D 2519/00034; B65D 2519/00039;
(Continued)

(56) References Cited

U.S. PATENT DOCUMENTS 3,730,378 A * 5/1973 Albinson ..... B65D 7/12 217/58
4,124,184 A * 11/1978 Juergens ..... E05C 5/00 292/241
(Continued)

FOREIGN PATENT DOCUMENTS

CN 202743592 U 2/2013
EP 0 232 585 A2 8/1987
(Continued)

OTHER PUBLICATIONS

Prof. Paul Brians, bias (Year: 2019).*
(Continued)

*Primary Examiner* — Nathan Cumar
(74) *Attorney, Agent, or Firm* — Foley & Lardner LLP

(57) ABSTRACT

The container has a lid structure comprising two lid panels. The first lid panel forms at least a part of the top wall. The second lid panel forms at least part of one of the side walls. When the container is in the erected condition the lid structure can have one of, and be moved between, a closed configuration; top load configuration; and, front load configuration. The front load configuration has two variants. In a first front load configuration the first and second lid panels remain connected to each other and are moved so that they are in a substantial face to face relationship. In the second front load configuration the second lid panel is pivoted to lie on top of the first lid panel.

11 Claims, 18 Drawing Sheets

(51) Int. Cl.
*B65D 45/02* (2006.01)
*E05C 19/14* (2006.01)

(52) U.S. Cl.
CPC ..... *B65D 2519/008* (2013.01); *B65D 2519/00034* (2013.01); *B65D 2519/00039* (2013.01); *B65D 2519/00069* (2013.01); *B65D 2519/00074* (2013.01); *B65D 2519/0082* (2013.01); *B65D 2519/00174* (2013.01); *B65D 2519/00179* (2013.01); *B65D 2519/00208* (2013.01); *B65D 2519/00213* (2013.01); *B65D 2519/00268* (2013.01); *B65D 2519/00288* (2013.01); *B65D 2519/00318* (2013.01); *B65D 2519/00338* (2013.01); *B65D 2519/00402* (2013.01); *B65D 2519/00407* (2013.01); *B65D 2519/00422* (2013.01); *B65D 2519/00427* (2013.01); *B65D 2519/00497* (2013.01); *B65D 2519/00587* (2013.01); *B65D 2519/00611* (2013.01); *B65D 2519/00641* (2013.01); *B65D 2519/00646* (2013.01); *B65D 2519/00721* (2013.01); *B65D 2519/00805* (2013.01); *B65D 2519/00875* (2013.01); *B65D 2519/00975* (2013.01); *E05C 19/14* (2013.01)

(58) Field of Classification Search
CPC ..... B65D 2519/00069; B65D 2519/00074; B65D 2519/00174; B65D 2519/00179; B65D 2519/00208; B65D 2519/00213; B65D 2519/00268; B65D 2519/288; B65D 2519/318; B65D 2519/338; B65D 2519/402; B65D 2519/407; B65D 2519/422; B65D 2519/427; B65D 2519/497; B65D 2519/587; B65D 2519/611; B65D 2519/641; B65D 2519/646; B65D 2519/721; B65D 2519/008; B65D 2519/00805; B65D 2519/0082; B65D 2519/00875; B65D 2519/00975; E05C 19/14
USPC ..... 292/161
See application file for complete search history.

(56) References Cited

U.S. PATENT DOCUMENTS 4,181,333 A * 1/1980 Stelma ..... E05C 19/14 292/113
4,789,075 A * 12/1988 Sun ..... B65D 11/1846 206/508
5,056,667 A * 10/1991 Coogan ..... B65D 19/12 206/600
5,445,422 A 8/1995 Weinerman et al.
6,203,075 B1 * 3/2001 Wells, Jr. ..... B65D 45/24 292/100
6,877,628 B2 * 4/2005 Nesting ..... B65D 7/30 206/600
8,418,914 B2 * 4/2013 Cormack ..... B65D 1/22 235/375
2003/0168866 A1 * 9/2003 Evans ..... E05C 19/14 292/71
2006/0076785 A1 * 4/2006 Eriksson ..... E05C 19/14 292/247
2006/0237455 A1 10/2006 Vargas
2007/0051720 A1 * 3/2007 Chen ..... B65D 11/1846 220/6
2011/0068588 A1 * 3/2011 Kopylov ..... E05C 19/14 292/200

FOREIGN PATENT DOCUMENTS

| | | | |
|---|---|---|---|
| FR | 1592818 | A | 5/1970 |
| GB | 0 696 234 | A | 8/1953 |
| GB | 1 221 664 | A | 2/1971 |
| JP | S5960131 | U | 4/1984 |
| JP | H08-121001 | | 5/1996 |
| JP | 2013-221343 | A1 | 10/2013 |
| WO | WO-97/31832 | A1 | 9/1997 |
| WO | WO-2013/149289 | A1 | 10/2013 |

OTHER PUBLICATIONS

Supplementary Partial European Search Report dated Sep. 21, 2017, in corresponding European Application No. 15857446.7, 6 pages.
Written Opinion of the International Searching Authority in PCT/AU2015/000673, dated Apr. 28, 2016, 8 pages.
International Search Report received in corresponding International Application No. PCT/AU2015/000673 dated Apr. 28, 2016, 7 pages.
International Preliminary Report on Patentability and Notification of Transmittal received in PCT/AU2015/000673 dated Oct. 28, 2016, 4 pages.
Supplementary Search Report dated Jan. 31, 2018, received in corresponding European application No. 15857446.7, 10 pages.
Office Action dated Oct. 2, 2019 in related Japanese Office Action No. 2017-542210, (3 pages) and English translation (4 pages).

* cited by examiner

CONTAINER

CROSS REFERENCE TO RELATED APPLICATIONS

The present application is a U.S. National Stage of International Application No. PCT/AU2015/000673 filed on Nov. 5, 2015, which claims the benefit of Australian Patent Application No. 2014904472 filed Nov. 6, 2014, the entire disclosures of all of which are incorporated herein by reference.

TECHNICAL FIELD

This specification discloses a container. The disclosed container may be used for the same purposes as, and instead of, common wooden pallets and intermediate bulk containers.

BACKGROUND ART

Pallets are used for the storage and/or transport of goods and other substances. The pallets are usually made from wood although plastic pallets are becoming more common. Once goods have been loaded onto a pallet the pallet can be lifted and moved short distances by a fork lift truck. The pallet can be transported large distances by being loaded onto or in road or rail vehicles, marine vessels or aeroplanes. To assist in retaining goods on pallets is also know to wrap a laden pallet in plastic film.

When a pallet carries goods or materials that form a flat surface and have weight bearing characteristics it is possible to stack one loaded pallet on top of another. This assists in reducing overall transport costs as it enables a vehicle such as a tray top truck to carry more goods laden pallets than if stacking were not possible. However this is not possible when for example a pallet is loaded with a machine or other goods of irregular shape or that may otherwise not be suitable for bearing the load of an additional stacked pallet.

An intermediate bulk container (IBC) is an industrial container used to carry bulk liquids and particulate materials. One common form of IBC consists of container made of a plastics material (e.g. polyethylene) housed within a rigid open frame. An IBC can be loaded onto a pallet. One relatively common problem is that the IBC is prone to accidental piercing by a fork lift truck. Also when carrying hazardous materials, after the IBC has been emptied, there usually remains some residue of the hazardous material. As a consequence the emptied IBC must still be transported in accordance with the same requirements as a full IBC.

The above references to the background art do not constitute an admission that the art forms part of the common general knowledge of a person of ordinary skill in the art. In addition the above description of the prior art is not intended to limit the application of the container disclosed herein.

SUMMARY OF THE DISCLOSURE

The present disclosure relates to a container and in particular, although by no means exclusively, to a container for storing and transporting goods, materials and commodities. To provide context the container may conveniently but not necessarily be configured to have a footprint of the same general size as a standard wooden pallet and/or IBC.

The disclosed container more particularly relates to a container having a lid structure that enables either front or top loading. The disclosed container is also able to be reconfigured between an erected condition, where walls of the container form an enclosed storage space, and a lay flat condition.

The disclosed container may include a liquid impervious bladder. The bladder can be formed of a material that can be collapsed or flattened. This enables the bladder when emptied to be removed from the storage space and flattened. The container itself can then be collapsed to the lay flat condition. By forming the walls of the container as solid walls the risk of piercing of the bladder is substantially reduced.

Also disclosed is a latch mechanism that may be used with or otherwise incorporated in the disclosed container to selectively latch panels/walls of the container, for example to control access to contents of the container. However the latch mechanism may also be used separately of, and not limited to use with, the disclosed container.

In one aspect there is disclosed a container comprising:

a bottom wall, a plurality of side walls and a top wall, the walls be coupled together to enable the container to be reconfigured between a lay flat condition and an erected condition while the walls remain coupled together, wherein when in the erected condition the walls form an enclosed storage space; and a lid structure comprising at least two lid panels wherein a first lid panel forms at least a part of the top wall and a second lid panel forms at least a part of one side wall;

the first lid panel being pivotally coupled to another of the side walls and detachably coupled to the second lid panel; the lid structure have a top load configuration wherein when the container is in the erected condition the first lid panel is capable of being decoupled from the second lid panel and pivoted to a position enabling top loading of the container while the second panel forms at least a part of the one side wall, a front load configuration where the first and second lid panels are connected to each other and moveable relative to each other to enable front loading of the container, and a closed configuration where the first and second lid panels act as respective parts of the top wall and one side wall to form the enclosed storage space.

In one embodiment the lid structure comprises a hinge mechanism comprising at least one member that is movable between an engaged position where the at least one member connects the first and second lid panels together and acts as a pivot axis enabling pivot motion of the first and second lid panels relative to each other, and a disengaged position enabling the second lid panel to be detached from the first lid panel.

In one embodiment the hinged mechanism is retained by one or both of the lid panels when in the engaged position and in the disengaged position.

In one embodiment the at least one member comprises at least two members wherein the at least two members are retained by one of the first lid panel and the second lid panel.

In one embodiment the at least one member comprises at least two members wherein a first of the at least two members is retained by the first lid panel and a second of the at least two of members is retained by the second lid panel.

In one embodiment the at least one members comprises at least one pin slidably mounted within one of the lid panels.

In one embodiment the first lid panel forms the top wall.

In one embodiment the second lid panel forms the one side wall.

In one embodiment each of the other side walls are formed of respective wall panels, each of the remaining wall panels being pivotally coupled to the base.

In one embodiment the lid structure is arranged to have two front load configurations these being a first front load configuration wherein both first and second lid panel are move to a location displaced from their location when the lid structure is in the closed configuration; and a second front load configuration where only the second lid panel move to a location displaced from its location when the lid structure is in the closed configuration.

In one embodiment the lid structure is arranged so that the second lid panel is capable of lying flat on the first lid panel when in the first front load configuration.

In one embodiment the bottom wall comprises a bunded pallet.

In one embodiment the container comprises a locking system arranged to lock the container in the erected condition to prevent unauthorised access to the enclosed space.

In one embodiment the locking system comprises a plurality of locking mechanisms which are fixed to respective associated walls of the container, each locking mechanism having a locked state where locking mechanism locks two associated walls together and an unlocked state enabling the associated walls to be moved relative to each other.

In one embodiment the locking system comprises a plurality of secure locks each capable of engaging a respect locking mechanism to prevent unauthorised change from the locked state to the unlocked state.

In one embodiment each locking mechanism comprises a drawbolt.

In one embodiment the container comprises a liquid impervious bladder disposed within the storage space, the bladder having at least sealable opening.

In one embodiment the at least one sealable opening is an inlet wherein the inlet is accessible when the lid structure is in the closed configuration.

In one embodiment the at least one sealable opening is an inlet wherein the inlet is accessible when the lid structure is in the top load configuration.

In one embodiment the container comprises a demountable divider configured to engage with an inside of two side walls when the container is in the erected condition and divide the storage space into a plurality of sub-spaces.

In one embodiment the demountable divider is self-supporting when engaged with the two side walls.

In one embodiment the demountable divider comprises at least two panels that are pivotally coupled together.

In one embodiment each of the two side walls is configured to engage with the demountable divider at a plurality of apart spaced locations.

In one embodiment each of the two walls is provided with a plurality of spaced channels for receiving a respective end of the demountable divider.

In one embodiment the container comprises at least one recess for receiving a respective electronically readable tag.

In one embodiment the container comprises at least one electronically readable tag received within a respective recess.

In a second aspect there is disclosed a latch mechanism comprising:

a lever capable of pivotal movement about a lever axis;

a latch member pivotally coupled about a latch axis to the lever, the latch member being movable by pivoting of the lever about the lever axis to reach and engage a catch;

wherein the lever and the latch member are biased to pivot in the same direction about their respective axes.

In one embodiment the latch mechanism comprises a lever spring arranged to bias the lever to pivot in a first direction and a latch spring arranged to bias the latch member to pivot in the first direction.

In one embodiment the latch spring acts between the lever and the latch member.

In one embodiment the lever spring acts between the lever and a base to which the lever is able to be pivotally coupled.

In one embodiment the lever spring and latch spring act independently of each other.

In one embodiment the latch member is coupled to the lever in a manner to enable adjustment of a distance between the lever axis and the latch axis.

In one embodiment the latch mechanism comprises a locking facility arranged to enable the lever to be locked against pivotal movement to an extent to enable release of the latch member from an engaged catch.

In one embodiment the locking facility comprises a lug and an opening in the lever, the lug and opening being juxtaposed such that the lug is able to extend through the opening when the lever is in a first state, and the lug being configured to receive a releasable locking device.

In one embodiment the latch mechanism comprises a bracket wherein the bracket includes the base.

In a third aspect there is disclosed a latch mechanism comprising:

a bracket, a lever coupled to the bracket for pivotal movement about a lever axis;

a latch member pivotally coupled about a latch axis to the lever;

wherein the lever and the latch member are biased to pivot about their respective axes in a direction toward the bracket.

In a fourth aspect there is disclosed latch mechanism comprising:

a lever coupled to pivot about a lever axis;

a latch member pivotally coupled about a latch axis to the lever;

the lever and the latch member both being biased to pivot in a first direction;

the lever and the latch member arranged to be movable between a released position and a latched position, wherein when in the latched position the lever is pivoted about the lever axis in a second direction being opposite to the first direction and is capable of engaging a catch, and wherein when in the released position the latch member overlies the lever;

the lever and the latch member further arranged so that when in the latched position upon applying a force on the lever to pivot the lever through a first angle in the second direction, the latch member is displaced from the catch wherein on subsequent release of the force both the lever and the latch member are biased to pivot in the first direction to the released position.

BRIEF DESCRIPTION OF THE DRAWINGS

Notwithstanding any other forms which may fall within the scope of the container as set forth in the Summary, specific embodiments will now be described, by way of example only, with reference to the accompanying drawings in which.

DETAILED DESCRIPTION OF SPECIFIC EMBODIMENTS

FIGS. 1*a*-1*d* depict an embodiment of the disclosed container 10 in respective different configurations. The container 10 in this embodiment comprises a bottom wall 12, a top wall 14, and four side walls 16*a*-16*d* (hereinafter referred to in general as "side walls 16").

Figure 1A:
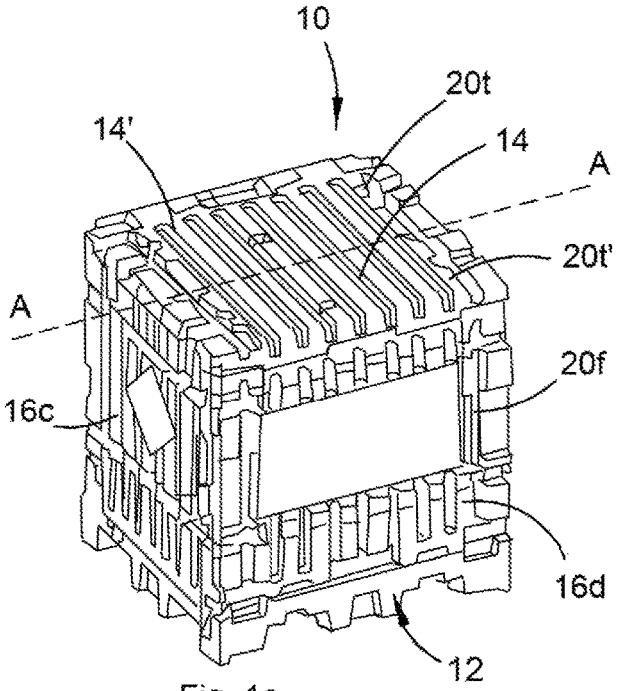
FIG. 1*a* is a schematic representation of an embodiment of the disclosed container when in an erected condition and with its lid structure in a closed configuration.
Figure 1B:
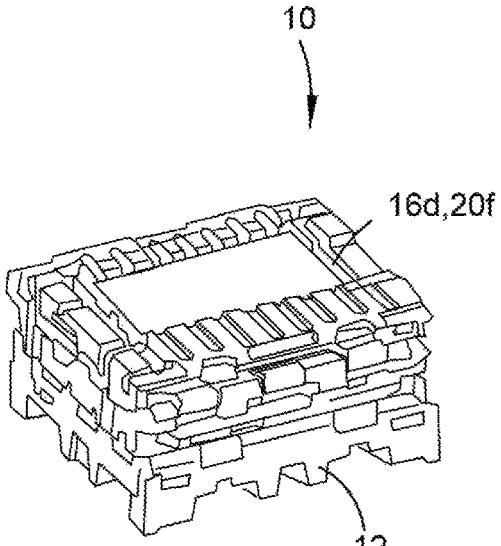
FIG. 1*b* is a schematic representation of the disclosed container of FIG. 1*a* in a lay flat condition.

When the container 10 is in the erected condition shown in FIG. 1*a* the bottom wall 12, top wall 14 and side walls 16 form an enclosed storage space.

In this embodiment the side walls 16*a*, 16*b* and 16*c* are coupled to the bottom wall 12, and the top wall 14 is coupled to both the side wall 16*b* and the side walls 16*d*. By virtue of this coupling the container 10 can be reconfigured to the lay flat condition shown in FIG. 1*b* where the respective walls overlie each other as well as the bottom wall 12. Thus the container 10 can be reconfigured between the erected condition shown in FIG. 1*a* and the lay flat condition shown in FIG. 1*b* by simply pivoting or folding various walls relative to other walls. All of the walls 12, 14 and 16 remain coupled together in these two configurations.

The container 10 has a lid structure 18 comprising two lid panels 20*t* and 20*f*. The first lid panel 20*t* forms a part of the top wall 14. Indeed, in this embodiment the first lid panel 20*t* constitutes the whole of the top wall 14. The second lid panel 20*f* forms at least part of one of the side walls 16*d*. More specifically in this particular embodiment the second lid panel 20*f* constitutes the whole of the side wall 16*d*. Thus in this embodiment the first lid panel 20*t* is one and the same as the top wall 14, and the second lid panel 20*f* is one and the same as the side wall 16*d*. Accordingly the lid structure 18 can also be considered as comprising the top wall 14 and the side wall 16*d*.

The first lid panel 20*t* is pivotally coupled to the side wall 16*b*. In addition the first lid panel 20*t* is detachably coupled to the second lid panel 20*f*. By virtue of the detachable coupling it is possible to decouple the first lid panel 20*t* from the second lid panel 20*f*.

When the container 10 is in the erected condition the lid structure 18 can have one of several different configurations. These configurations include a closed configuration shown in FIG. 1*a*, a top load configuration shown in FIG. 1*c*, and a front load configuration shown in FIG. 1*d*. As will be explained with reference to a second embodiment the front load configuration shown in FIG. 1*d* may be one of two different front load configurations. In the second front load configuration the second lid panel 20*f* is pivoted to lie on top of the first lid panel 20*t*, the first lid panel 20*t* remaining unmoved, parallel to and overlying the bottom wall 12.

In the closed configuration shown in FIG. 1*a* the lid structure 18 is arranged so that the first lid panel 20*t* and the second lid panel 20*f* constitute the top wall 14 and side wall 16*d* and form, together with the remaining walls of the container 10, the enclosed storage space.

Figure 1C:
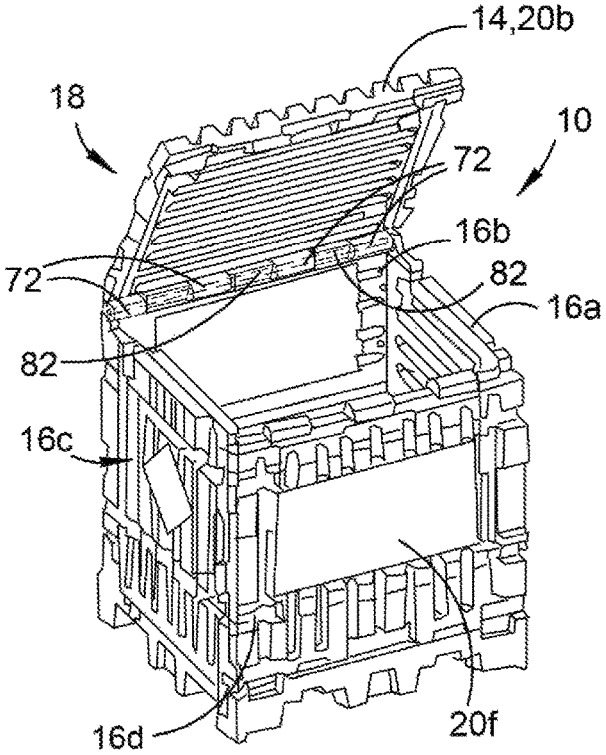
FIG. 1*c* is a schematic representation of the disclosed container with its lid structure in a top load configuration.

When the lid structure 18 is in the top load configuration shown in FIG. 1*c*, the first lid panel 20*t* is: detached from the second lid panel 20*f*; and, then pivoted to a position enabling top loading of the container 10. In this condition the second lid panel 20*f* forms part, and indeed the whole, of the side wall 16*d* and remains disposed between the side walls 16*a* and 16*c*.

In the top load configuration depicted in FIG. 1*c* the first lid panel 20*t* is shown nearly directly above the side wall 16*b*. However the first lid panel 20*t* will not normally be held in this position. Rather this may be a transition position either back to the closed configuration show in FIG. 1*a* or to a rest position where the lid panel 20*t* is swung further so as to lie face to face with the side wall 16*b* on an outside of the container 10.

Figure 1D:
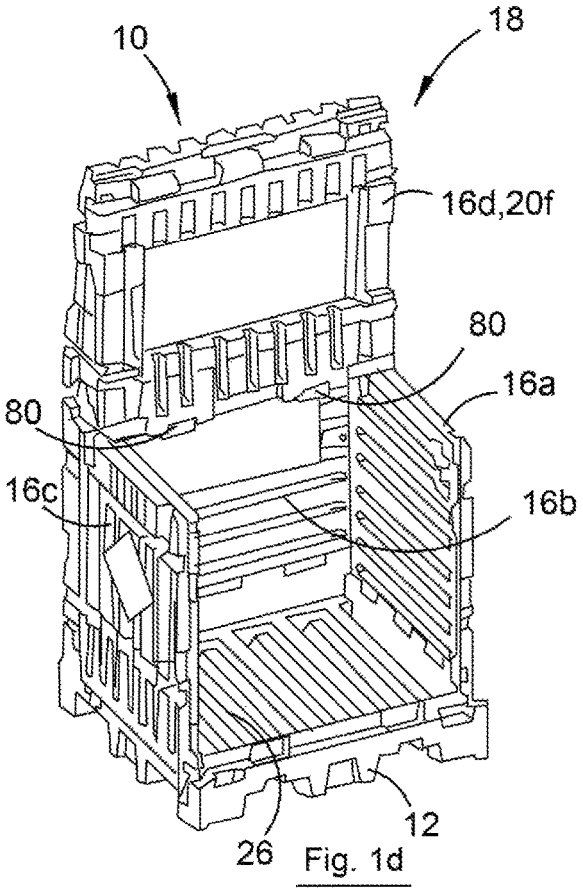
FIG. 1*d* is a schematic representation of the disclosed container with its lid structure in a front load configuration.
Figure 2A:
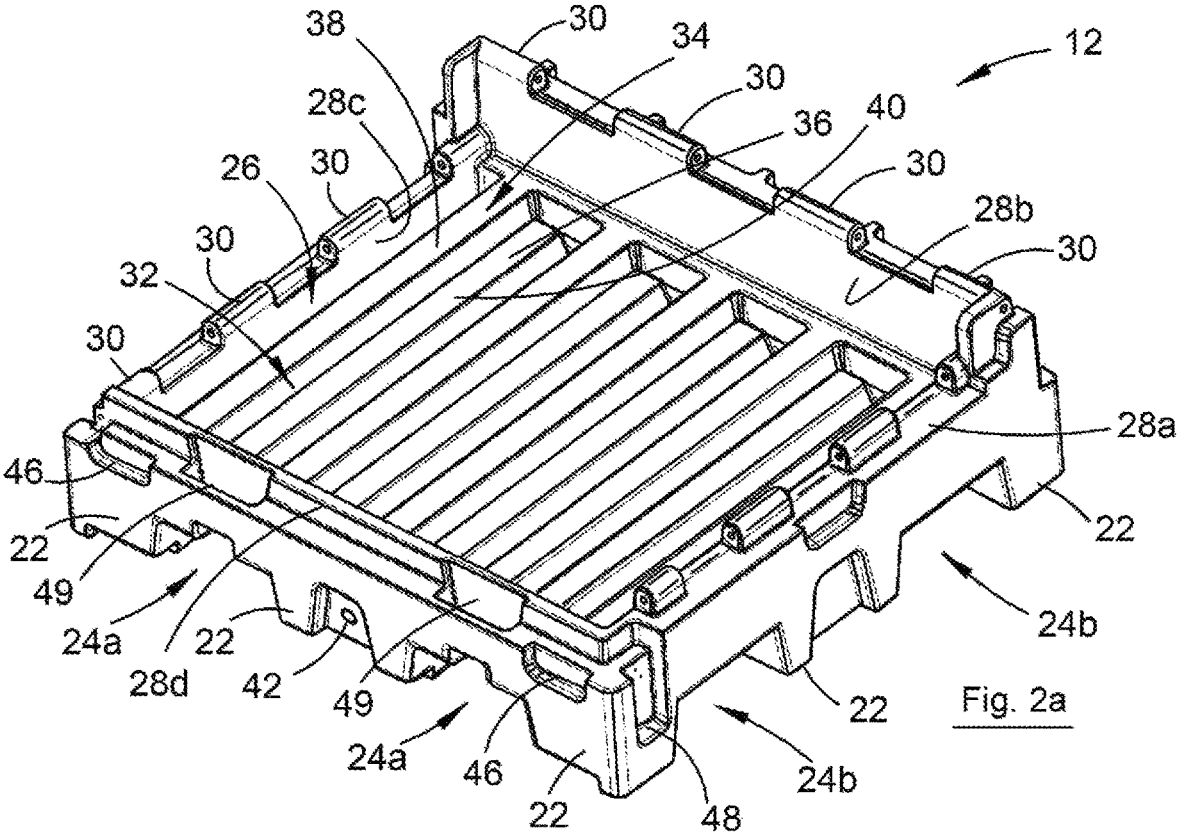
FIG. 2*a* is a top isometric view of a bottom wall of the container shown in FIG. 1*a;*
Figure 2B:
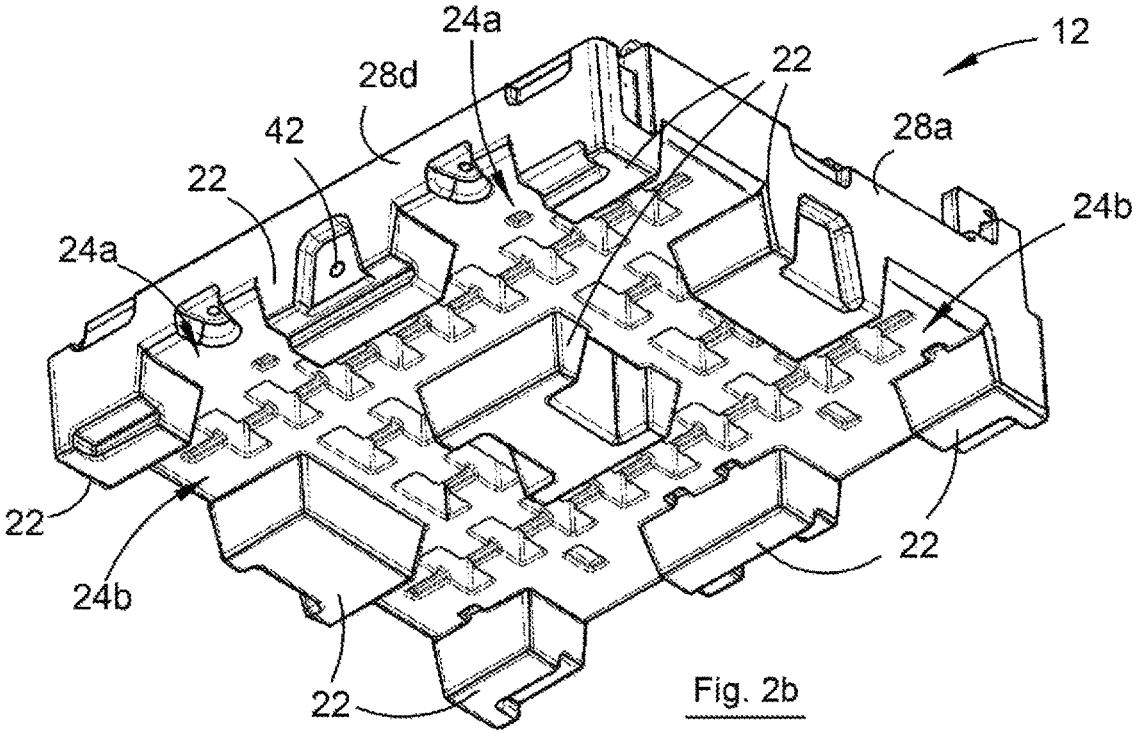
FIG. 2*b* is a bottom isometric view of the bottom wall shown in FIG. 2*a;*
Figure 2C:
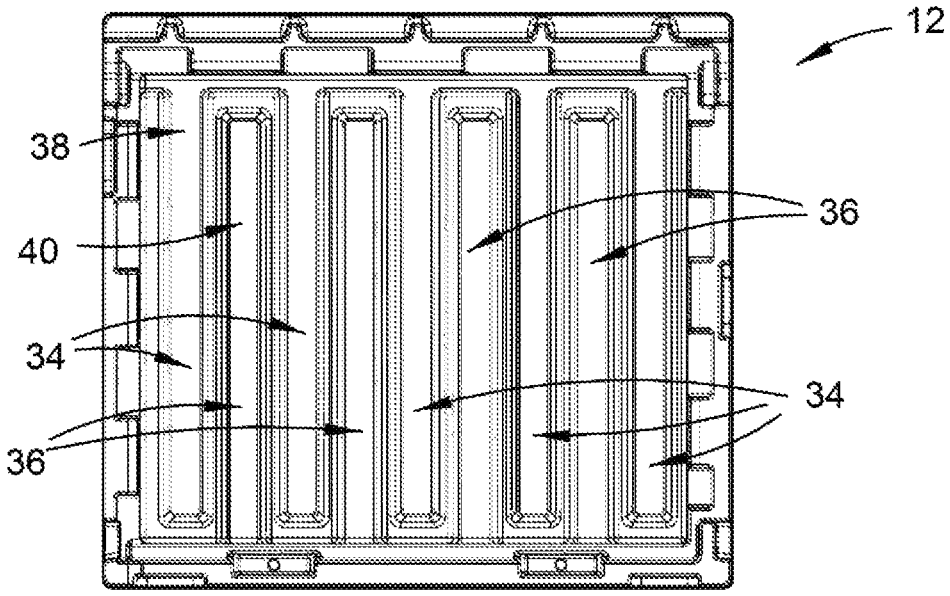
FIG. 2*c* is a top elevation of the bottom wall shown in FIG. 2*a;*
Figure 2D:
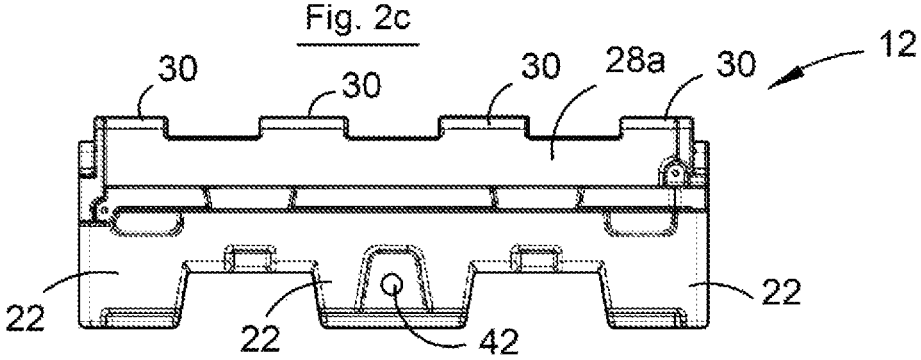
FIG. 2*d* is a front elevation of the bottom wall shown in FIG. 2*a;*
Figure 2E:
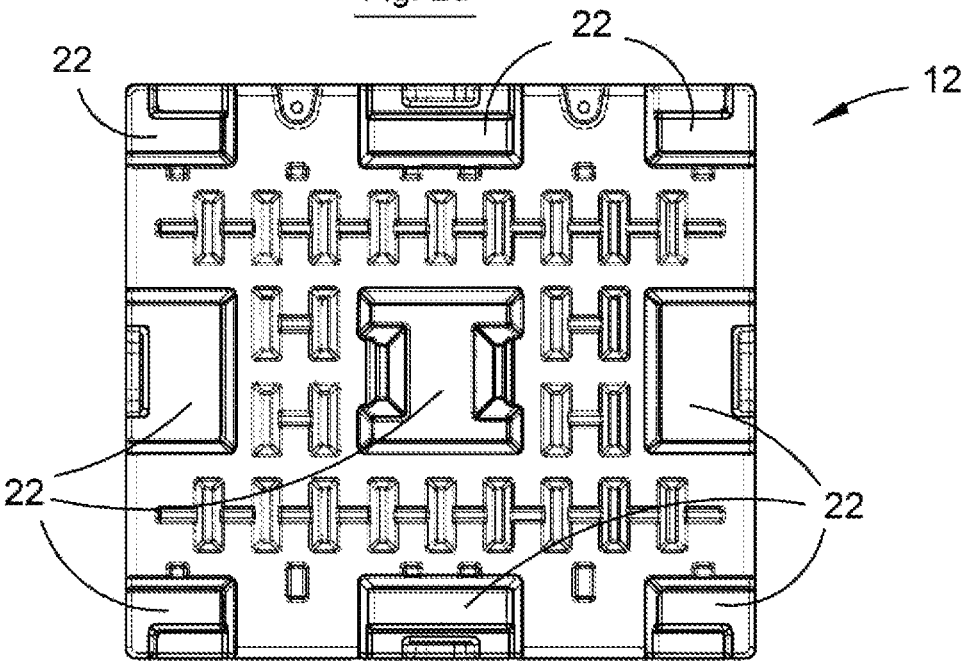
FIG. 2*e* is a bottom elevation of the bottom wall shown in FIG. 2*a;*
Figure 2F:
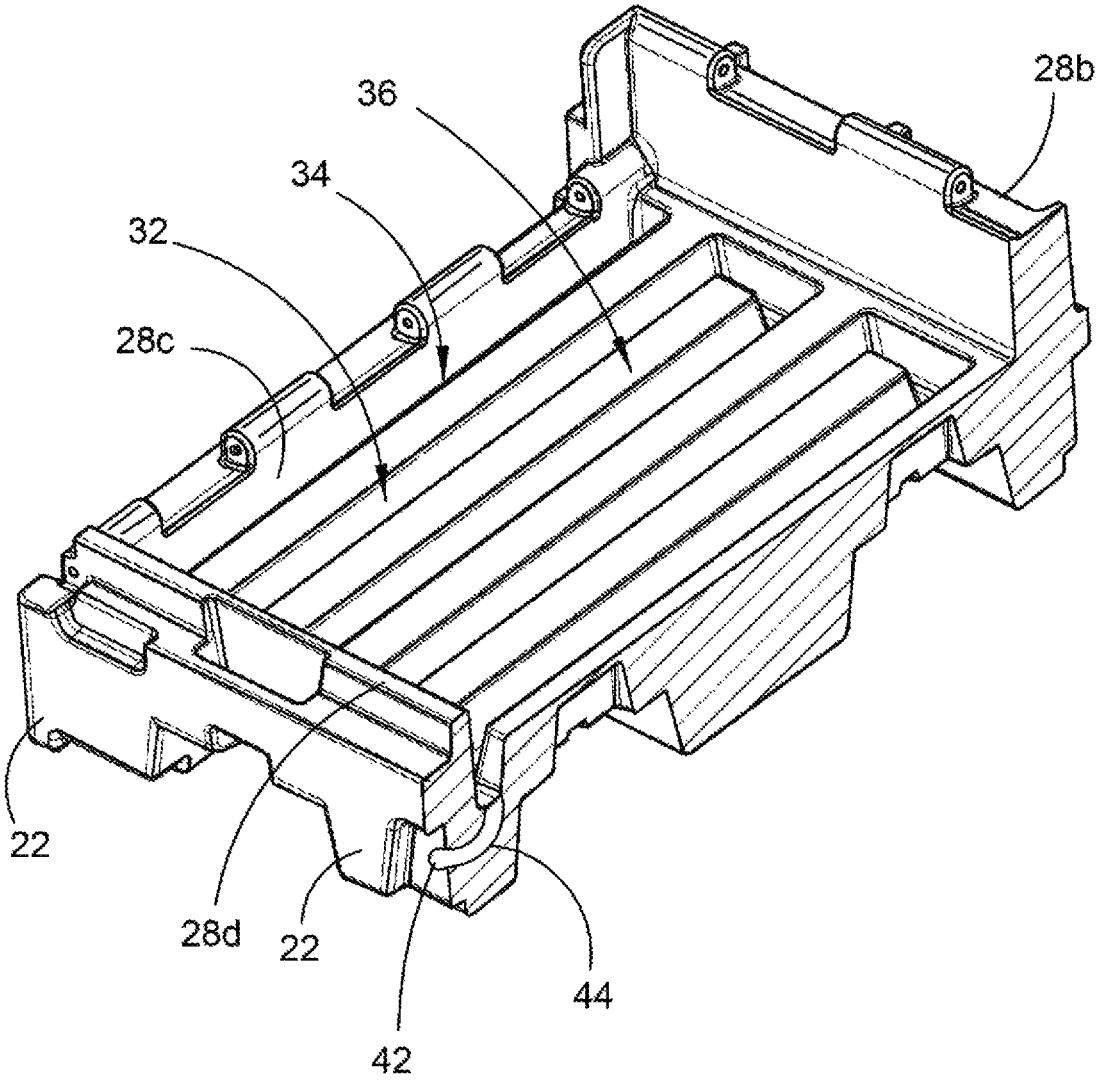
FIG. 2*f* is a section view of the bottom wall shown in FIG. 2*a;*
Figure 3A:
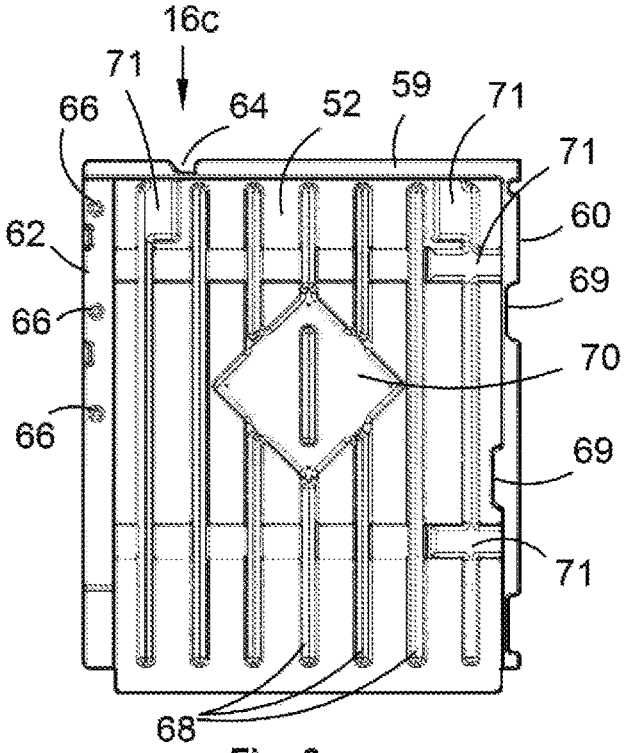
FIG. 3*a* is a front elevation of one of the side walls of the container shown in FIG. 1*a;*
Figure 3B:
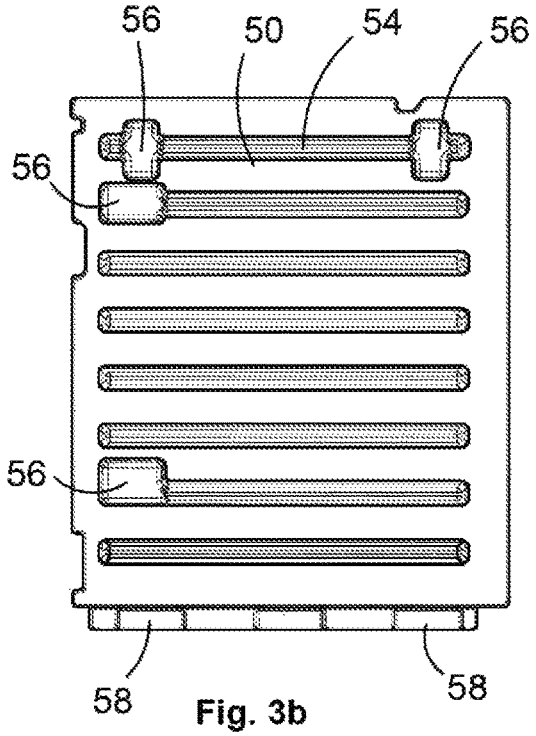
FIG. 3*b* is a back view of the side wall shown in FIG. 3*a;*
Figure 3C:
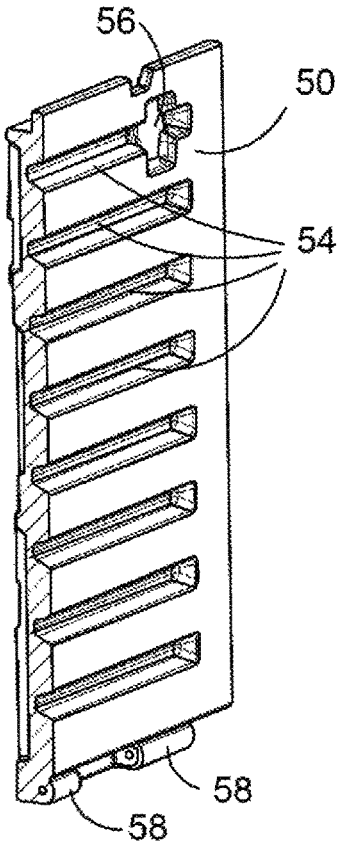
FIG. 3*c* is a section view of the side wall shown in FIG. 3*a;*

FIG. 1*d* depicts the lid structure 18 in a first of two possible the front load configurations. In the first front load configuration the first and second lid panels 20*t* and 20*f* remain connected to each other. Further, the lid panels 20*t* and 20*f* can be moved and in this instance pivoted relative to each other to open the container 10 and enabling front loading of goods or materials onto the bottom wall 12. More particularly both the first and second panels 20*t* and 20*f* are moved from their respective closed configuration positions so that they are in a substantial face to face relationship, with the second lid panel 20*f* resting on the top edges of the side panels 16*a* and 16*c*.

FIGS. 2*a*-2*f* depicts the bottom wall 12 of the container 10. The bottom wall 12 is configured to receive members of a lifting apparatus such as the forks of a forklift truck. This enables lifting of the container 10 from beneath the bottom wall 12. This is facilitated by providing the bottom wall 12 with a plurality of spaced apart legs 22. In this instance the bottom wall 12 has nine legs 22 arranged in a three by three matrix like pattern as shown most clearly in FIG. 2*b*. This arrangement of legs 22 forms a first pair of channels 24*a* and a second pair of channels 24*b* (hereinafter referred to in general as "channels 24"). Each respective pair of channels 24 is able to receive the forks of a forklift truck. Further each pair of channels open onto opposite sides of the container 10; and the pair of channels 24*a* is perpendicular to the pair of channels 24*b*. Thus the base 12 and consequently the container 10 can be lifted by a forklift truck of other lifting apparatus driven or moved toward the container 10 in a direction front on to any one of the four side walls 16.

The bottom wall 12 is further configured to form a bunded pallet. This is achieved by configuring the bottom wall 12 to form a liquid receiving receptacle 26. Thus any liquid which spills or otherwise leaks from any item loaded onto the bottom wall 12 is able to flow into and be contained within the receptacle 26.

The receptacle 26 is defined between four walls 28*a*-28*d* (hereinafter referred to as "walls 28") of the bottom panel 12. In order of height the wall 28*c* is the lowest followed by walls 28*d* and 28*a* which are of the same height, and then wall 28*b* which is the highest of the walls 28. Each of the walls 28*a*, 28*b* and 28*c* is formed with integral hinge portions 30. The hinge portions 30 are in the form of spaced apart raised tubular structures. As will be explained in greater detail later, the hinge portions 30 cooperate with complementary hinge portions on side walls 16*a*, 16*b* and 16*c* to form hinges that couple the corresponding side walls to the bottom wall 12 and also enable relative pivoting motion.

The wall 28*d* is not provided with hinge portions. Rather it forms a lip or wall delimiting the forward extent of the receptacle 26 and also acting as a stop for the second lid panel 20*f* (side wall 16*d*).

A serpentine channel 32 forms part of the liquid collection volume or space of the receptacle 26. The channel 32 winds between alternating and spaced apart ribs 34 and 36 formed in an inside of the bottom panel 12. The serpentine channel 32 is depicted by way of dots in FIG. 2*c*. The ribs 34 and 36 have respective planar surfaces 38 and 40. These surfaces are of the same height as each other. Thus together the ribs 34 and 36 form a support surface on the bottom wall 12.

A drainage opening 42 is formed in the bottom wall 20 and opens onto a middle leg 22 adjacent the wall 28*d*. The drainage opening 42 communicates with the serpentine channel 32 via an internal conduit 44 (see FIG. 2*f*). A stopcock or other valve (not shown) can be coupled to the drainage opening 42 to control the drainage of the receptacle 26.

Various recesses and pockets are formed on the bottom wall 12 for different purposes. One set of recesses 46 (see FIGS. 2*a* and 2*b*) is provided for seating or otherwise receiving identification tags such as RFID tags. Respective second recesses 48 are formed, one in each legs 22 at the opposite ends of the wall 28*d*. The recesses 48 receive parts of a latch mechanism (described later) which may be used to lock the container 10 in the closed configuration. Pockets 49 are also provided in the bottom wall 12 along the wall 28*d* on opposite sides of a central one of the legs 22.

FIGS. 3*a*-3*d* depict an embodiment of the side wall 16*c*. The side wall 16*c* is in this embodiment in the form of a single one piece panel. The side wall 16*c* has an inner face 50 and an outer face 52. When the container 10 is in the erected condition the face 52 is on an outside of the container 10. The inner face 50 is formed with a plurality of laterally extending spaced apart channels 54. A plurality of recesses 56 is formed in the inner face 50. Hinge portions 58 are formed along one edge of the panel 16*a*. The hinge portions 58 are in the form of spaced apart tubular structures. In the container 10, the hinge portions 58 interleave with corresponding hinge portions 30 along the wall 28*c*. A pivot pin or axle (not shown) can then be passed through the interleaved hinge portions 30 and 58 to form a hinge coupling between the wall 16*a* and the bottom wall 12.

An upper lip 59 and opposite side lips 60 and 62 extend about the side wall 16*c*. With reference to the container 10 being in the erected condition, the lip 59 runs along an upper edge of the wall 16*c*; the lip 60 extends along a side edge of the side wall 16*c* adjacent the side wall 16*d*; and the lip 62 runs along an opposite side edge of the side wall 16*c* adjacent the side wall 16*b*. The lip 59 is formed with a cut out 64. A number of depressions 66 are formed along the lip 62.

The outer surface 52 is formed with a plurality of longitudinally extending channels 68. A central diamond shaped recess 70 is also formed centrally in the outer surface 52. The recess 70 may receive signage which may for example contain warnings or a description of contents or intended contents of the container 10. Also cutaways 69 are provided on the side wall 16*c* to enable lifting/pivoting of the side wall 16*c* from the lay flat condition to the erected condition.

Latch recesses 71 are formed in the outer face 52. The latch recesses 71 are in alignment with respective recesses 56 on the inner face 50.

The side wall 16*a* has a configuration which is a mirror image of the side wall 16*c*.

Figure 4A:
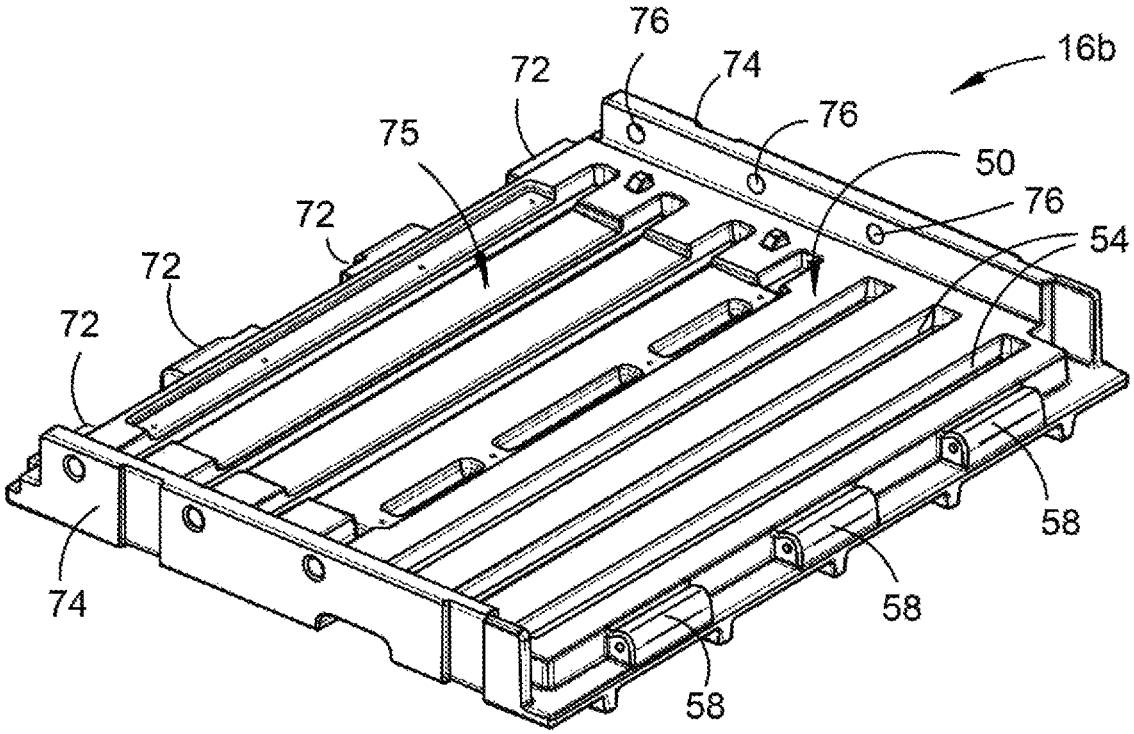
FIG. 4*a* is a front isometric view of a back wall of the container shown in FIG. 1*a;*
Figure 4B:
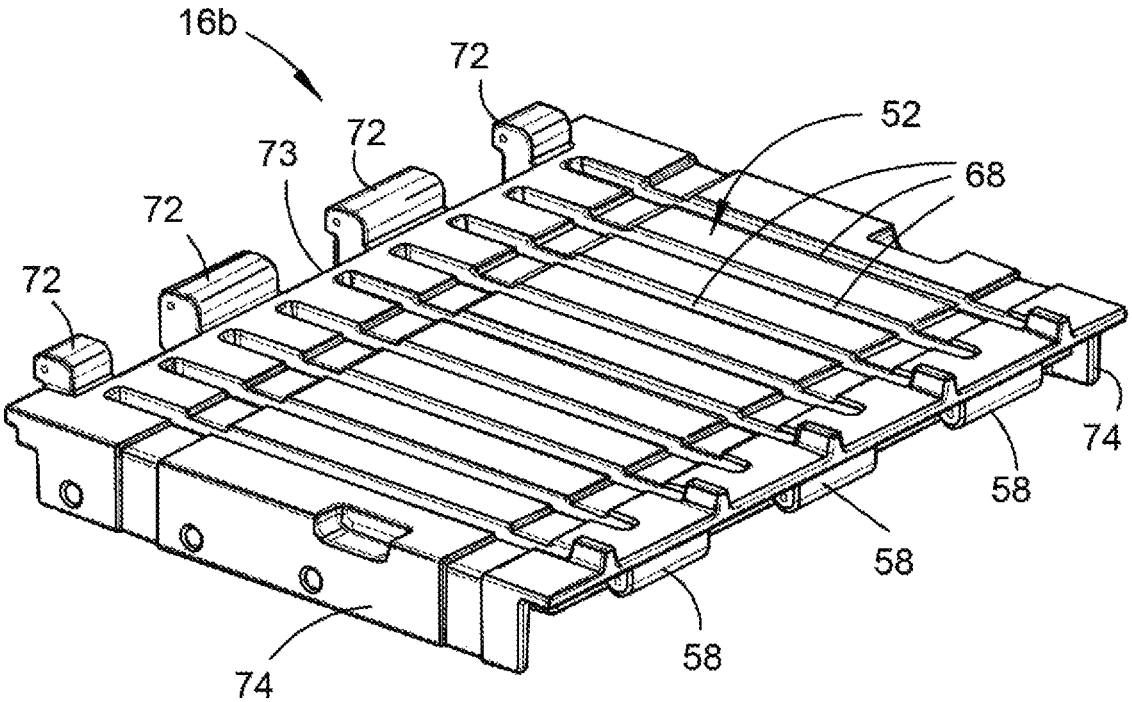
FIG. 4*b* is a back isometric view of the back wall shown in FIG. 4*a;*

FIGS. 4*a* and 4*b* depict the side wall 16*b*. In the present embodiment the side wall 16*b* can be considered to form the backside wall or more simply the back wall of the container. For the purposes of more easily differentiating the side wall 16*b* from the side walls 16*a* and 16*c*, the side wall 16*b* will be also referred to as the back wall 16*b*.

The back wall 16*b* is of generally the same configuration as the wall 16*a* and 16*c* having an inner face 50 with and an outer face 52. The inner face has a plurality of laterally extending spaced apart channels 54; and the outer face has a plurality of longitudinally channels 68. Hinge portions 58 similar to those of the side walls 16*a* and 16*b* are provided along one edge of the back wall 16*b*.

However the back wall 16*b* differs from the side walls 16*a* and 16*c* as follows. The back wall 16*b* is formed hinge portions 72 along an upper edge 73 opposite the hinge portions 58. A further difference in the back wall 16*b* is the provision of opposite side lips 74 that extend perpendicular to the plane of its inner and outer faces 50 and 52. The lips 74 are formed with raised dimples 76 on a side internal of the container 10 when in the erected condition. The dimples 76 are located so as to seat within the depressions 66 formed on the walls 16*a* and 16*c*. A rectangular depression 75 is also formed in the Inner face 50. The depression 75 can receive a sign that is viewable when the lid structure 18 is in the front load configuration.

Figure 5A:
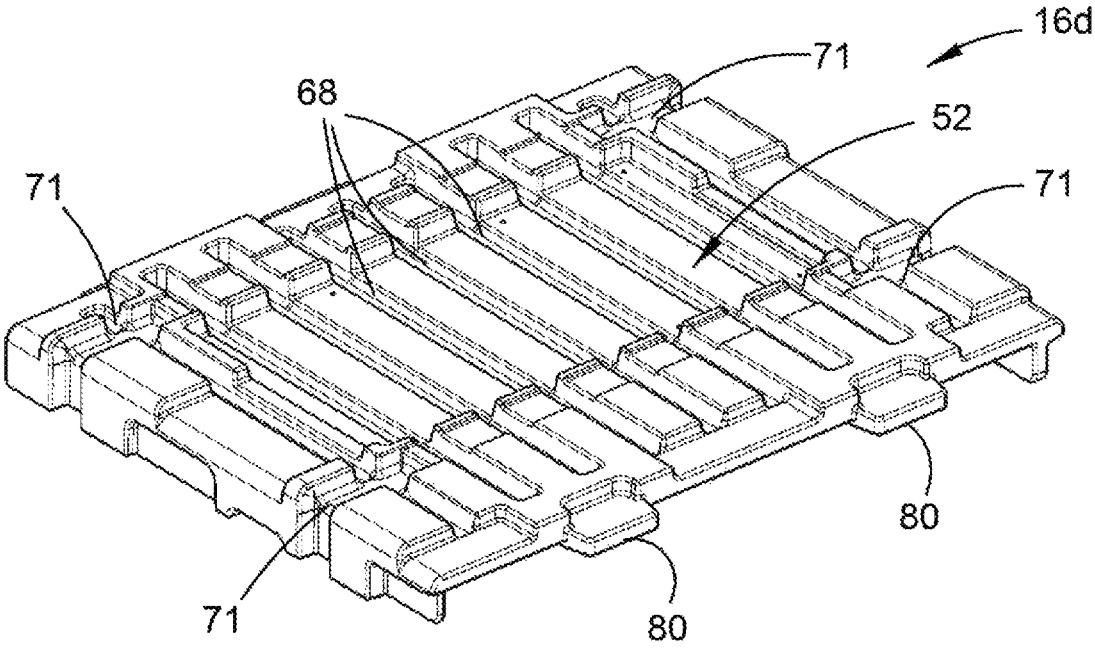
FIG. 5*a* is a front isometric view of a front wall of the container shown in FIG. 1*a;*
Figure 5B:
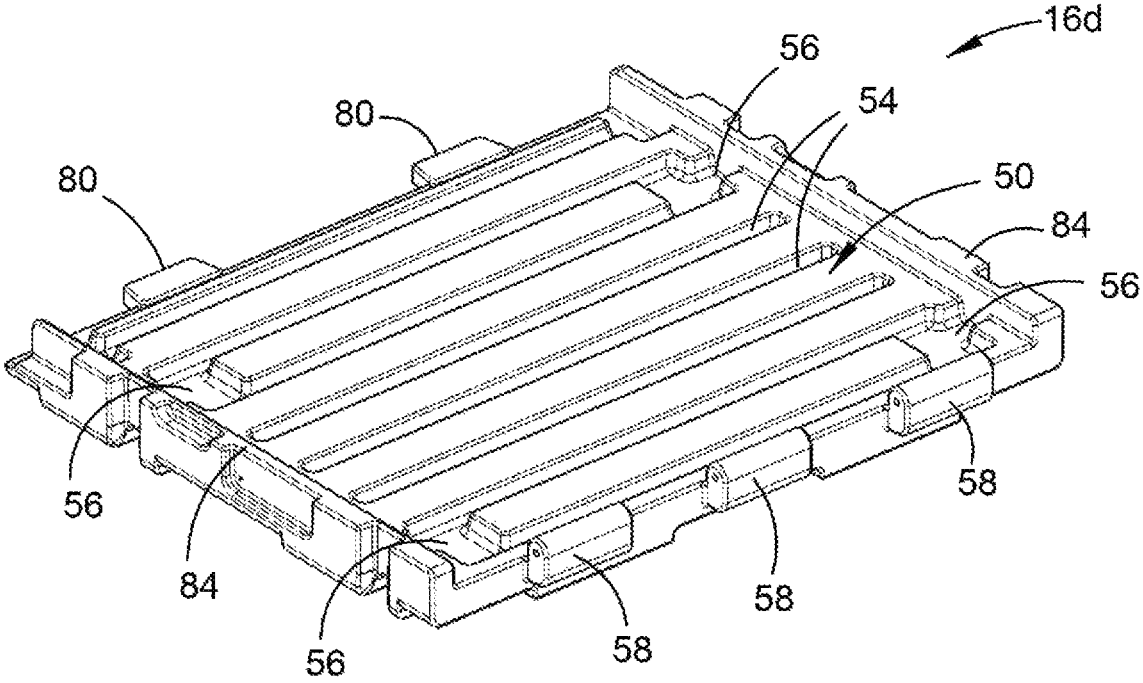
FIG. 5*b* is a back isometric view of the front wall shown in FIG. 5*a;*

FIGS. 5*a* and 5*b* depict one possible configuration of the side wall 16*d*. The side wall 16*d* has a hybrid configuration in comparison to the side walls 16*a*/16*c*; and the side wall 16*b*. In this embodiment the side wall 16*d* can be considered to form the front side wall or more simply the front wall of the container 10. For the purposes of more easily differentiating the side wall 16*d* from the side walls 16*a* and 16*c*, the side wall 16*b* will be also referred to as the front wall 16*b*.

The front wall 16*d* is in the form of a single panel having an inner surface 50 with transverse channels 54 and an outer surface 52 with longitudinal channels 68. A lower edge of the front wall 16*d* is formed with a pair of spaced apart lugs 80. The lugs 80 are received within the pockets 49 when the container 10 is in the erected condition with the lid structure 18 in the closed configuration. The front wall is also provided with four recesses 56 on its inner face 50 and corresponding aligned recess 71 on its outer face 52.

The front wall 16*d* has a plurality of spaced apart hinge portions 58 along an edge opposite the lugs 80. The two remaining edges of the front wall 16*d* are formed with lips 84 that extend in a plane transverse to that of its inner and outer faces 50, 52. The lips 84 are configured so that when the lid structure 18 is in the closed configuration the lips 84 overlie the lips 60 on the side walls 16*a* and 16*c*.

Figure 6A:
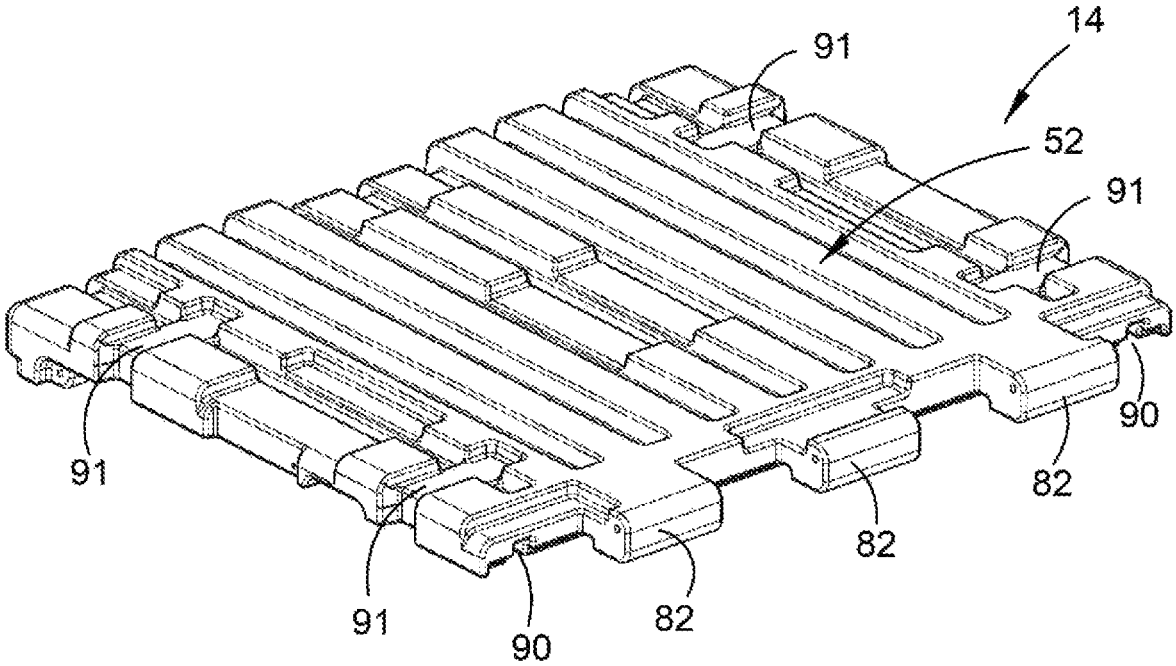
FIG. 6*a* is a top isometric view of a top wall of the container shown in FIG. 1*a;*
Figure 6B:
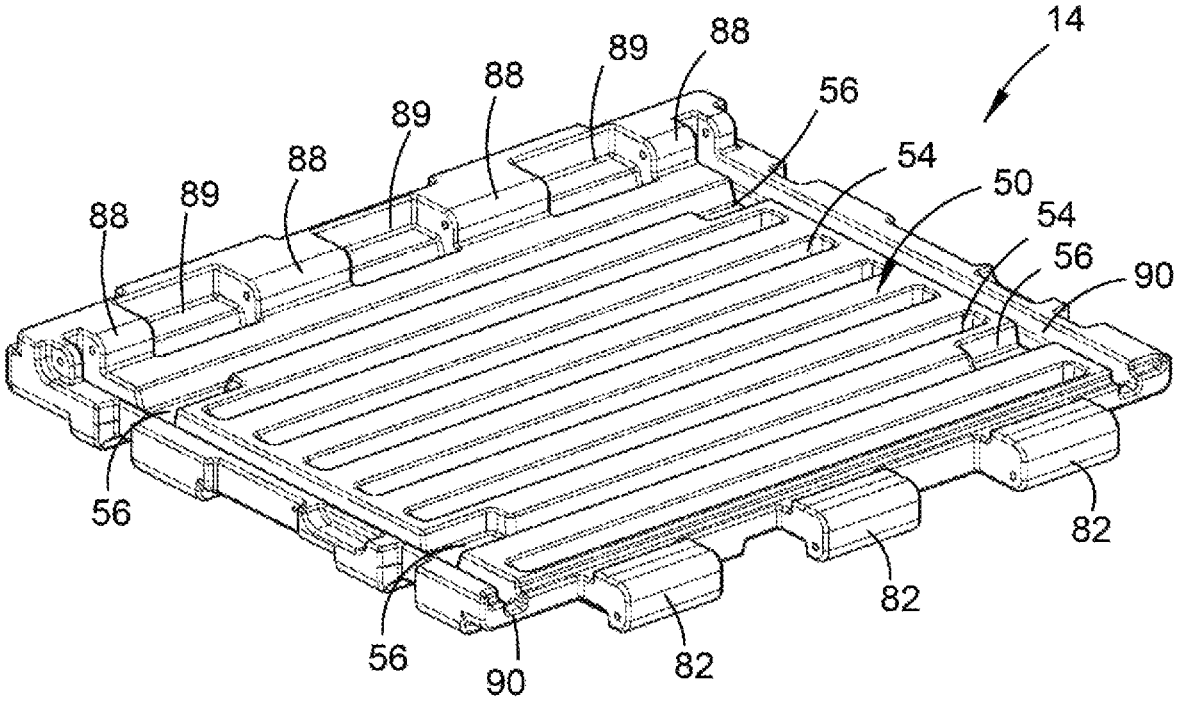
FIG. 6*b* is a bottom isometric view of the top wall shown in FIG. 6*a;*

FIGS. 6*a* and 6*b* depict one configuration of the top wall 14. The top wall is formed as a single panel. The top wall 14 has an inner face 50 with transverse channels 54, and an outer face 52 with transverse channel 68. The top wall 14 is also provided with four recesses 56 on its inner face 50 and corresponding aligned recess 71 on its outer face 52.

One edge of the top wall 14 is formed with a plurality of spaced apart hinge portions 82. The hinge portions 82 are in the form of integral tubular structures which are received between the hinge portion 72 on the back wall 16*b*. An opposite edge of the top wall 14 is formed with a plurality of hinge portions 88 which are spaced by recesses 89. The hinge portions 88 are in the form of hollow structures. In the fully assembled container 10, the hinge portions 88 interleave with the hinge portions 58 on the front wall 16*d* to enable the formation of a hinge coupling. The hinge portions 58 being received in the recesses 89.

Each of the two remaining edges of the top wall 14 is formed with respective channels 90. The channels 90 lie inboard of the inner face 50 but open at one end onto the edge having the hinge portions 82. When the container 10 is in the erected condition with the lid structure 18 in the closed configuration the channels 90 receive the upper lips 59 of the side walls 16*a* and 16*c*.

The outer face 52 is also formed with recesses 91 configured and located to receive the legs 22 of another container 10. This assists in stacking of containers on top of each other and enabling cubing out of: transport vehicles such as trucks and trains; and, sea containers.

The walls 16*a*, 16*b* and 16*c* are permanently attached to the bottom wall 12 by way of respective pivot pins. One pivot pin couples the hinge portions 30 and 58 of the walls 28*a* and 16*a*. Another pivot pin couples the hinge portions 30 and 58 of the walls 28*b* and 16*b*. Another pivot pin connects the hinge portions 30 and 58 of the walls 28*c* and 16*c*.

A further pivot pin connects the hinge portions 72 of the back wall 16*b* to the hinge portions 82 of the top wall 14.

Figure 7B:
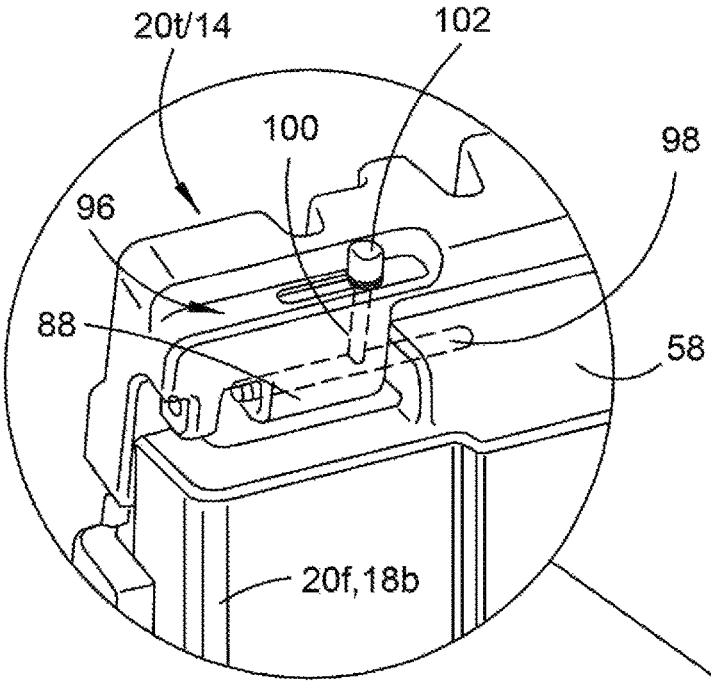
FIG. 7*b* is an enlarged view of the hinge mechanism in an engaged state.
Figure 7A:
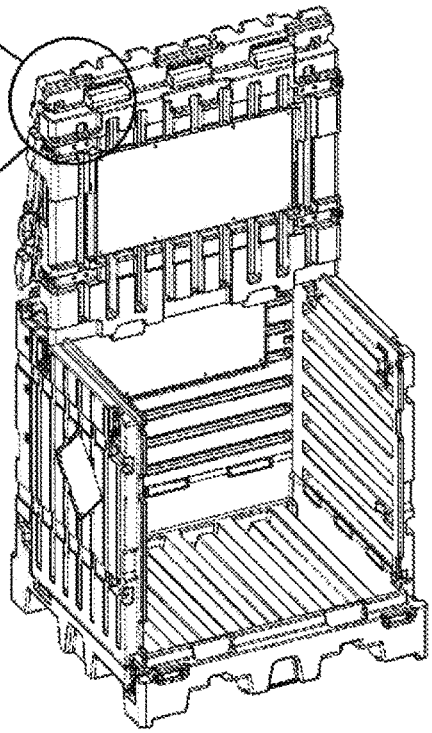
FIG. 7*a* is a schematic representation of the container as depicted in FIG. 1*d* but showing the location of a hinge mechanism incorporated in the container.
Figure 7C:
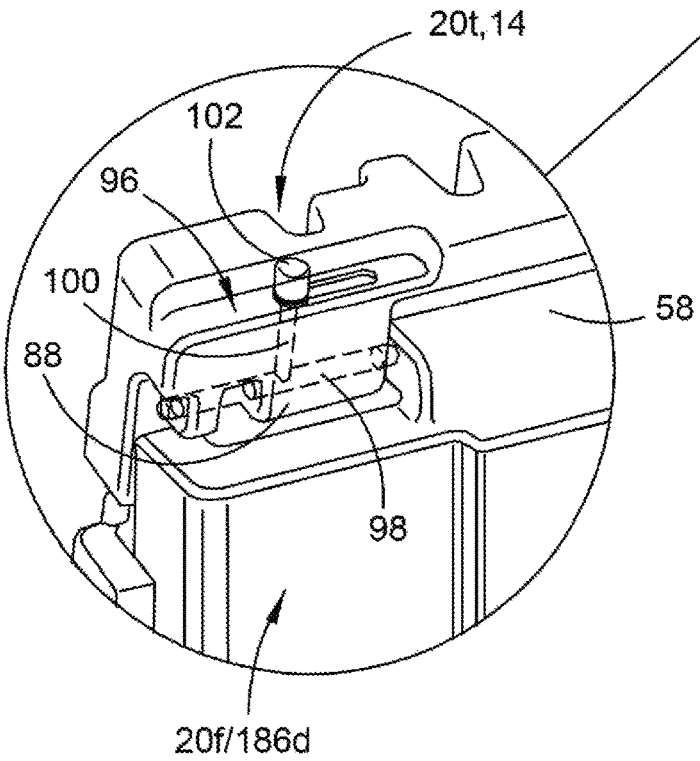
FIG. 7*c* is an enlarged view of the hinge mechanism in a disengaged state.

FIGS. 7*a*, 7*b* and 7*c* depict a hinge mechanism 96 that demountably couples the top wall 14 to the front wall 16*d*. As previously explained the combination of the top wall 14 and the front wall 16*d* forms the lid structure 18. Further in this embodiment the top wall 14 and the front wall 16*d* also constitute the first lid panel 20*t* and 20*f* respectively.

The hinge mechanism 96 is movable between an engaged position shown in FIG. 7*b* where the first and second lid panels 20*t* and 20*f* are pivotally coupled together, and a disengaged position shown in FIG. 7*c* where the first and second lid panels 20*t* and 20*f* are disengaged from each other. When the hinge mechanism 96 is in the engaged position the first and second lid panels 20*t* and 20*f* can be pivoted relative to each other.

When the hinge mechanism 96 is in the engaged position the lid structure 18 can be moved to the front load configuration shown in FIGS. 1*d* and 7*a*. In this front load configuration both of the lid panels 20*t* and 20*f* are moved from (or displaced relative to) their respective locations when the lid structure 18 is in the closed configuration shown in FIG. 1*a*. This front load configuration enables loading from the front of the container. Additionally the top of the container 10 is opened to allow easy access to the rear of the storage space.

The hinge mechanism 96 comprises two members in the form of bolts 98. In FIGS. 7*b* and 7*c* only one of the bolts 98 is depicted. A second of the bolts is provided in an opposite corner of the panels 20*t* and 20*f*.

From FIG. 7*b* it will be seen that when the hinge mechanism 96 is in the engaged position the bolt 98 extends partially within the hinge portions 88 and 58 of the first and second lid panels 20*t* and 20*f* respectively. However when the hinge mechanism 96 is in the disengaged position shown in FIG. 7*c* the bolt 98 resides within the hinge portion 88 and is totally withdrawn from the hinge portion 58. This enables the second lid panel 20*f* to be physically detached or decoupled from the lid panel 20*t*.

A lever 100 is attached to the bolt 98 and extends through a slot 102 formed in the lid panel 20*t* (i.e. top wall 14). A handle or knob 102 is attached to the end of the lever 100 opposite the bolt 98. A friction washer 104 between the knob 102 and the lever 100 creates friction which retains the bolt 98 in a position in the absence of the application of an external force.

In use, a user will be able to apply a force on the knob 102 overcoming the friction of the washer 104 to slide the bolt 98 as required to engage or disengage the hinge mechanism 96.

FIG. 1*c* depicts the container 10 with the hinge mechanism 96 in a disengaged position and the lid structure 18 in the top load configuration. In this configuration the second lid panel 20*t*/front wall 16*d* is coupled to the upper side wall 16*a* and 16*c*. Thus in this configuration the container 10 is in the form of an open top box.

The container 10 also comprises a latching system 110 (refer to FIGS. 8*a* and 8*b*) which is arranged to lock the container 10 in the erected condition to prevent unauthorised access to the enclosed storage space. The latching system 110 comprises a plurality of latch mechanisms 112 which are fixed to respective associated walls 12, 14 and 16. Each latch mechanism 112 has a latched state where the latch mechanism latches two associated walls together and an unlatched state enabling the associated walls to be moved relative to each other.

Each latch mechanism 112 has a catch 114, lever 120 and latch member 118. The catch, which is in the form of a plate with a hook at one end, is attached to one wall and a latch body 116 that comprises the lever 120 and latch member 118 is attached to an adjacent wall. The latch member 118 is pivotally connected to the lever 120 which in turn is pivotally connected to a bracket attached to the associated wall.

Figure 8A:
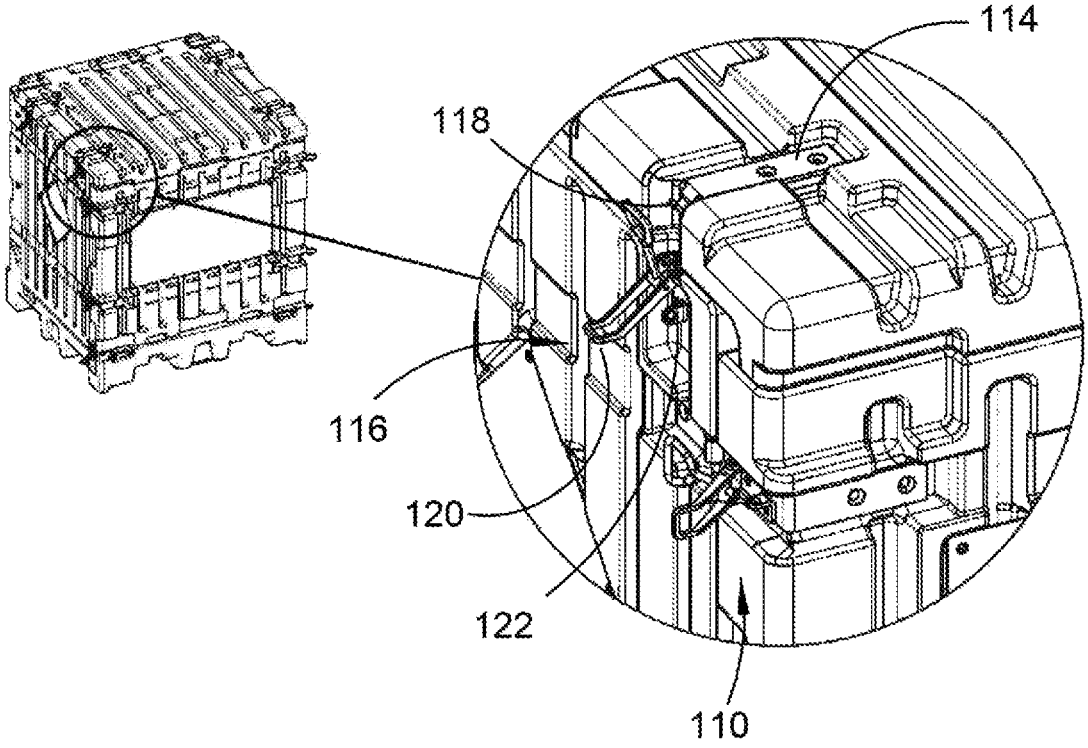
FIG. 8*a* is a view of the container in the closed state together with an enlarged detail of a first embodiment of a latch mechanism incorporated in the container when in an unlatched state.

FIG. 8*a* depicts the latch mechanism 112 in the disengaged state where the latch body 116 is disengaged from the catch 114. In particular, the latch member 118 is spaced from the catch 114.

Figure 8B:
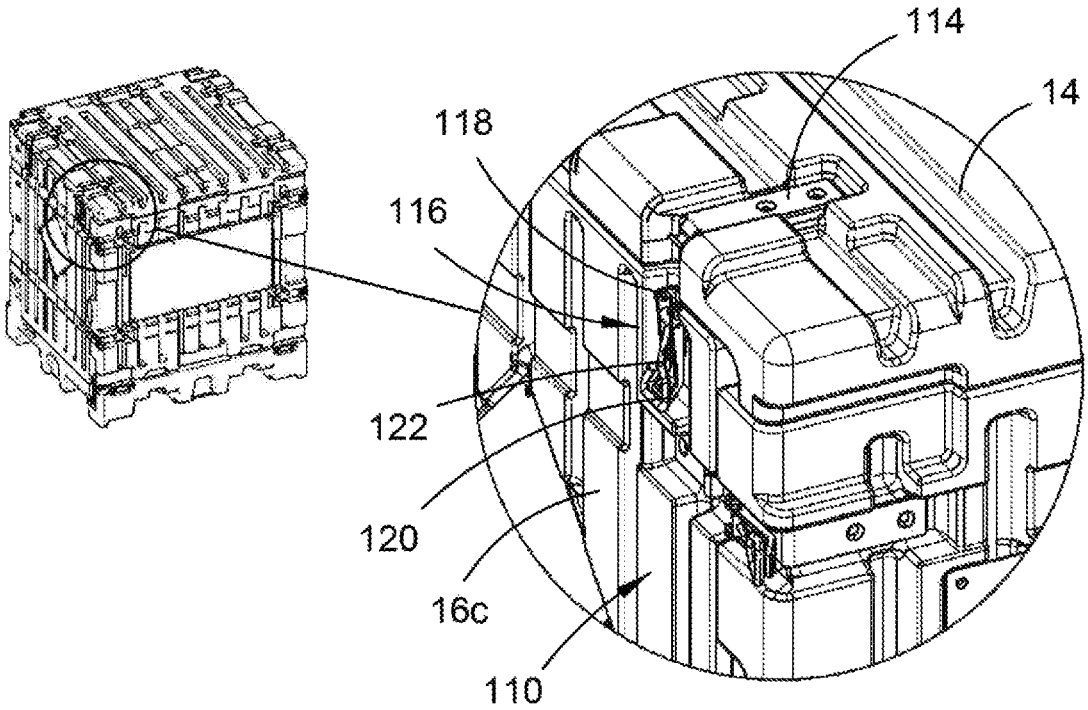
FIG. 8*b* is a view of the container in the closed state together with an enlarged detail of the latch mechanism incorporated in the container when in a latched state.

FIG. 8*b* depicts the latch mechanism 112 in the engaged or locked state. Here the latch body 116 engages the hook plate 114. Moreover the latch member 118 is engaged with the catch 114 and the lever 120 has been pivoted down to lie substantially flush with the associated side wall 16*c*. Now the walls 16*c* and 14 are latched together. An eye 122 extends through a central region of the lever 120 when the latch mechanism 112 is in the latched state. A secure lock such as a padlock can be engaged with the eye 122 thereby preventing the lever 120 from being pivoted upwards. This in effect locks the latch mechanism 112 to prevent unauthorised access to the storage space.

Each of the catches 114 and the latch bodies 116 are disposed within corresponding recesses 71 formed on the outer faces 52 of the respective walls. Additionally, in order to strengthen the connection of the latching system 110 to the container 10 metallic fastening plates (not shown) are also provided within respective recesses 56 formed on the inner faces 52 of the corresponding walls. Bolts (not shown) fasten the catches 114 and the latch bodies 116 to the fastening plates in the recesses 56. The recesses 56 and 71 are configured to neatly fit the respective parts of locking mechanism and in a manner to lie below the exposed surface of the outer faces 52. This assist in protecting the latch parts from being tampered with.

In this particular embodiment the latching system 110 is formed with ten latch mechanisms 112. Two latch mechanisms 112 operate between the top wall 14 and the side wall 16*a*; two latch mechanisms 112 act between the side wall 16*a* and front wall 16*d*; two latch mechanisms 112 act between the bottom wall 12 and the front wall 16*d*; two latch mechanisms 112 act between the top wall 14 and the side wall 16*c*; and two latch mechanisms 112 act between the side wall 16*c* and the front wall 16*d*.

In addition to providing a degree of security to the contents of the container the latching system 110 also provides the container 10 with increased structural strength. This is most evident when all the latch mechanisms 112 are in the latched state (irrespective of whether padlocks are fitted to the eyes 122) and the container 10 is accidentally dropped or run into by a vehicle. The latch mechanisms 112 will tend to keep the walls between which they operate in a fixed spatial relationship.

Figure 9:
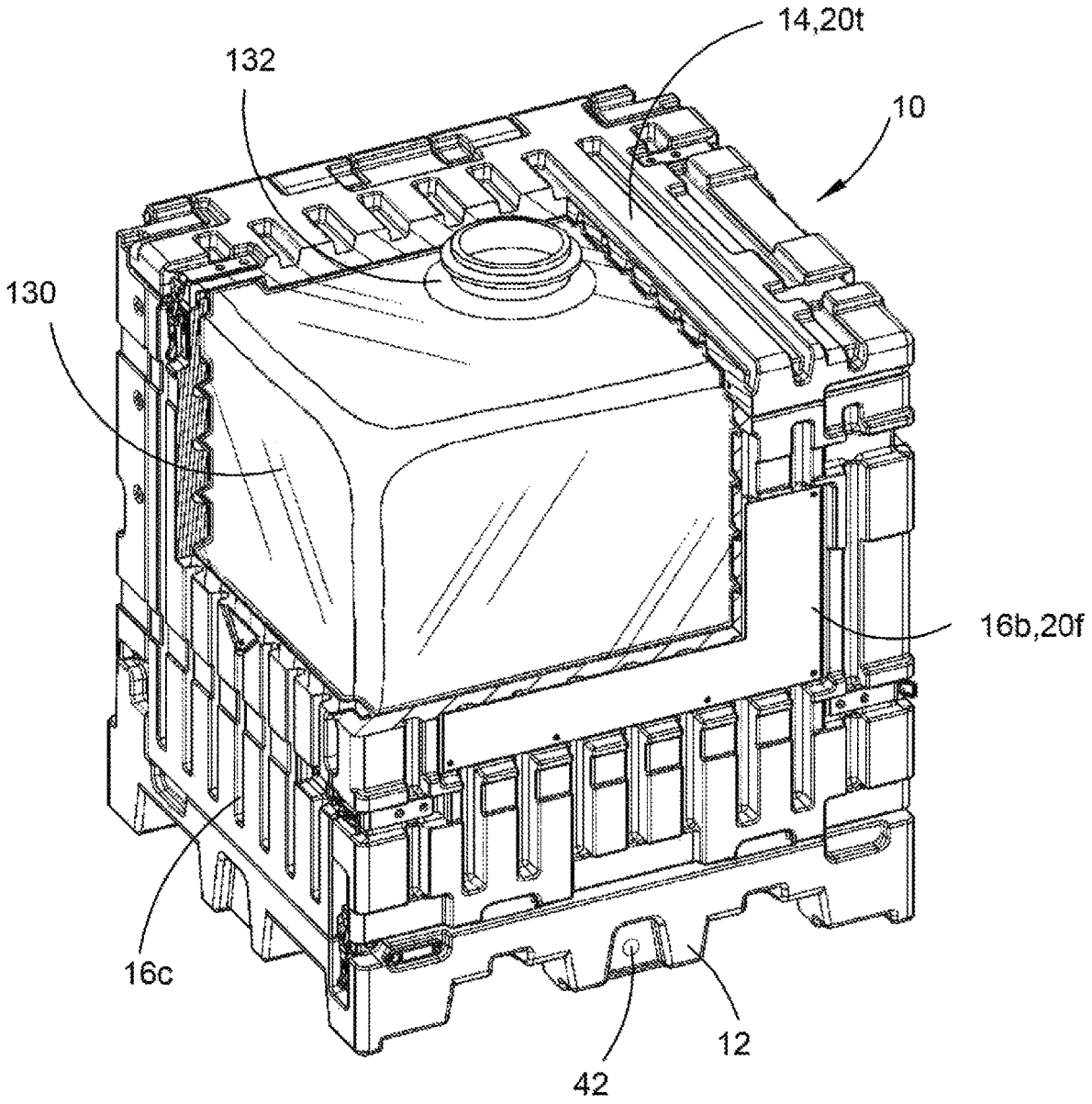
FIG. 9 is a cutaway view of an embodiment of the container suitable for the transport and storage of liquids or fine particles.

In order to enable the container 10 to be used for liquids or particulate matter, the container 10 may incorporate a bladder 130 as shown in FIG. 9. The bladder 130 is made of a shape which substantially conforms to the inner faces of the walls 12, 14 and 16 of a container 10 when in the erected condition with the lid structure 18 in the closed configuration. The bladder 130 has an inlet 132 with a removable lid (not shown). The inlet 132 is accessible when the lid structure is in the top load configuration.

The bladder 130 is made of a liquid impervious material. Further, the material from which the bladder 130 is made can be pliable and/or flexible. In this way, when the container 130 has been emptied of its contents the bladder 130 may be flattened to take up a volume substantially equal to its footprint area times about four times the thickness of the material from which the bladder 10 is made. When in this condition the inlet 132 can of course be closed with its lid. Therefore any residue within the bladder 130 is maintained within the flattened bladder. However now the container 10 can also be moved to the collapsed or lay flat position as shown in FIG. 1*d*. Therefore once the container 10 with bladder 130 has been emptied it can be collapsed to a substantially smaller volume therefore greatly reducing further transport or carting costs.

Figure 10A:
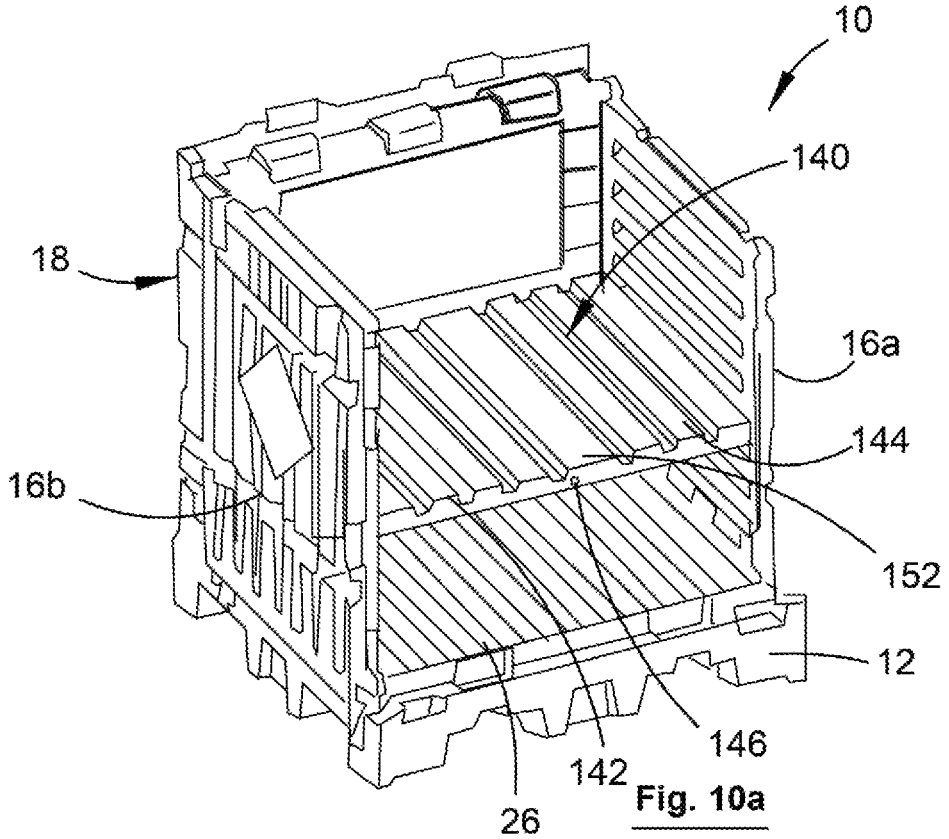
FIG. 10*a* is a schematic representation of the container incorporating a demountable divider with the divider in a ready for use configuration.
Figure 10B:
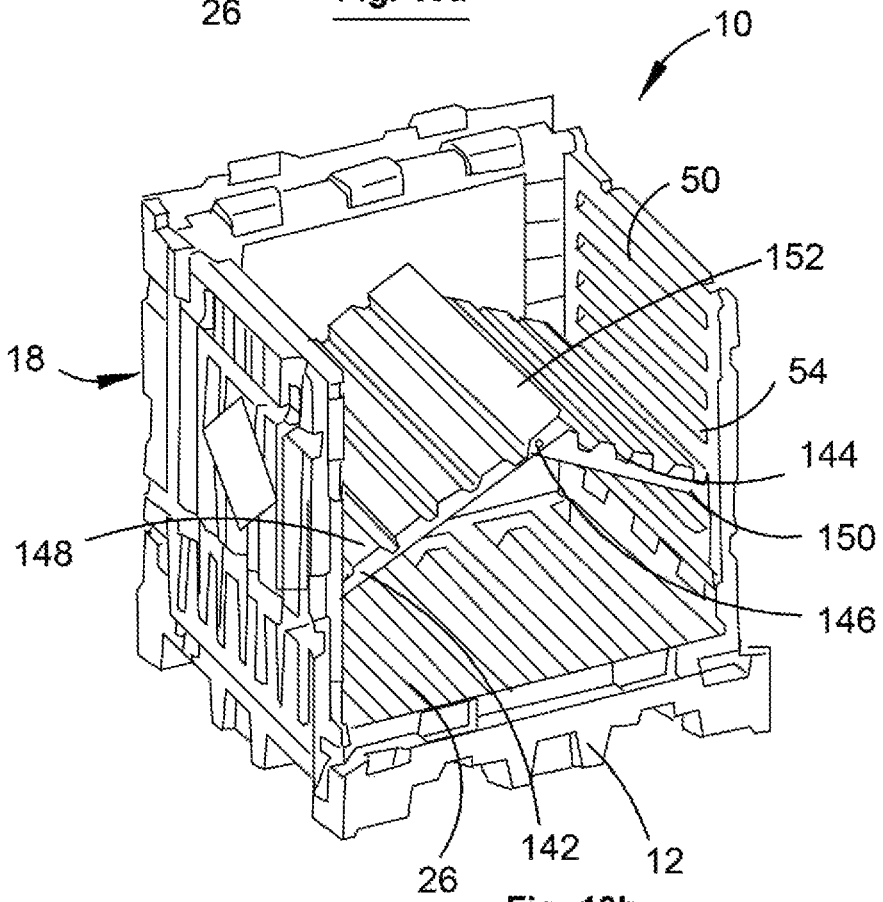
FIG. 10*b* is a schematic representation of the container with the divider of FIG. 10*a* in the process of being installed into the container.

FIGS. 10*a* and 10*b* depict a demountable divider 140 that may be incorporated in embodiments of the container 10. The divider 140 is configured to engage with the inner faces 50 of two of the side panels 16*a* and 16*c*. Further, the divider 140 is self-supporting within the container 10 so as to divide the storage space into a plurality of subspaces.

The divider 140 comprises two panels 142 and 144 which are pivotally coupled together by a pivot pin 146. Opposite ends 148 and 150 of the divider 140 are configured to seat within the channels 54 on the inner faces 50. Also, the panel 142 is provided with a flange 152 that extends beyond the pivot pin 146 and is arranged to abut against the panel 144 when the two panels 142 and 144 are substantially parallel. Thus the flange 152 acts to hold the divider 140 in a substantially horizontal plane as shown in FIG. 10*b*. In this manner the divider 10 is self-supporting within the container 10.

Each of the walls 12, 14 and 18 is made as an individual panel. In some embodiments these panels can be made from plastics or composite materials using a variety of known manufacturing techniques including blow moulding, injection moulding and rotor moulding. Different types of plastics materials of different thickness may be used depending on the specific use of the container 10. Non-limiting examples of materials from which the walls 12, 14 and 16 can be made include: various types of polypropylene such as HDPE, MDPE, LDPE; composite materials such as glass or carbon fibre composites; and aluminium.

The container 10 is well suited for use as a universal segregation pallet. In one embodiment the container 10 may have a width of about 1,150 mm, a depth of about 960 mm, and a height of about 1,160 mm. In one embodiment the load carrying capacity of the container with the above dimensions may be in the order of one tonne. This equates for example to approximately sixty five standard car lead acid batteries.

In order to place the container 10 in a lay flat condition from the erected condition the lid structure 18 is opened and moved to the front load configuration shown in FIG. 1*d* and then subsequently pivoted rearwardly a further 180° so that the lid structure 18 lies face to face with the back wall 16*b*. Next the side panel 16*c* is pivoted 90° inwardly so as to overlie the bottom wall 12. The opposite side wall 16*a* is now pivoted 90° inwardly to lie on top of the side wall 16*c*. Next the back wall 16*b* together with the folded lid structure 18 is pivoted forward by 90° so as to lie on top of the side wall 16*a*.

In the event that a divider 140 is installed in the container 10, the divider 140 will be removed prior to collapsing the container 10 to the lay flat condition. In some embodiments, the bottom wall 12 may be configured so that the divider 140 can be received within the receptacle 26 prior to folding down the walls 16 and 14 to place the container 10 in the lay flat condition. In such embodiments the divider 140 is therefore retained within the lay flat container rather than having to be separately handled. Whilst a specific embodiment of the container 10 has been described, it should be appreciated that the container 10 may be embodied in many other forms.

For example in one form or variation the first lid panel may be formed as only a part of the top wall 14. With reference to FIG. 1*a* this may be achieved for example by forming the top wall 14 as two separate pieces which are permanently hinged together along axis AA. Thus for example the top 14 will be formed as a top wall portion 14' and a first lid panel 20*t*'. In such an arrangement the front load configuration of the lid structure 18 is the same as shown in FIG. 1*d*. However the container can now have two different top load configurations. In both the top load configurations the entirety of the top wall 14 is decoupled from the front wall 16 by use of the hinge mechanism 96 as described above. However after this decoupling either

- the entirety of the top wall 14 can be pivoted through 270° to open the entirety of the top of the container 10; or
- the first lid portion 20*t*' can be pivoted about axis AA through 180° so as to lie on top of the top wall portion 14'. Now one half of the top area of the container 10 is open.

Figure 11A:
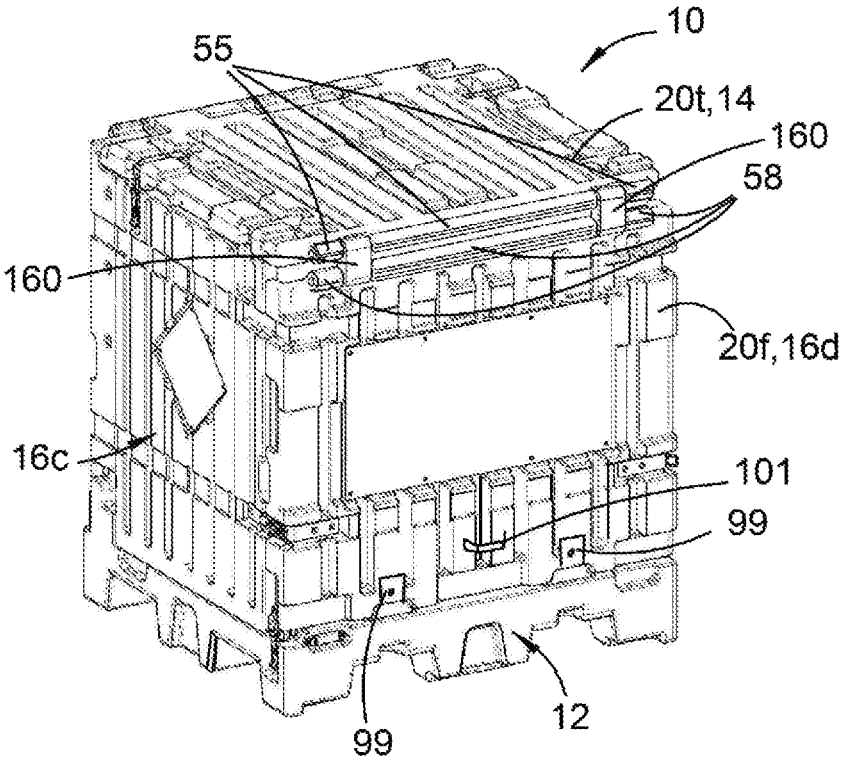
FIG. 11*a* is a schematic representation of a further embodiment of the container when in the erected condition and with its lid structure in the front load configuration.
Figure 11B:
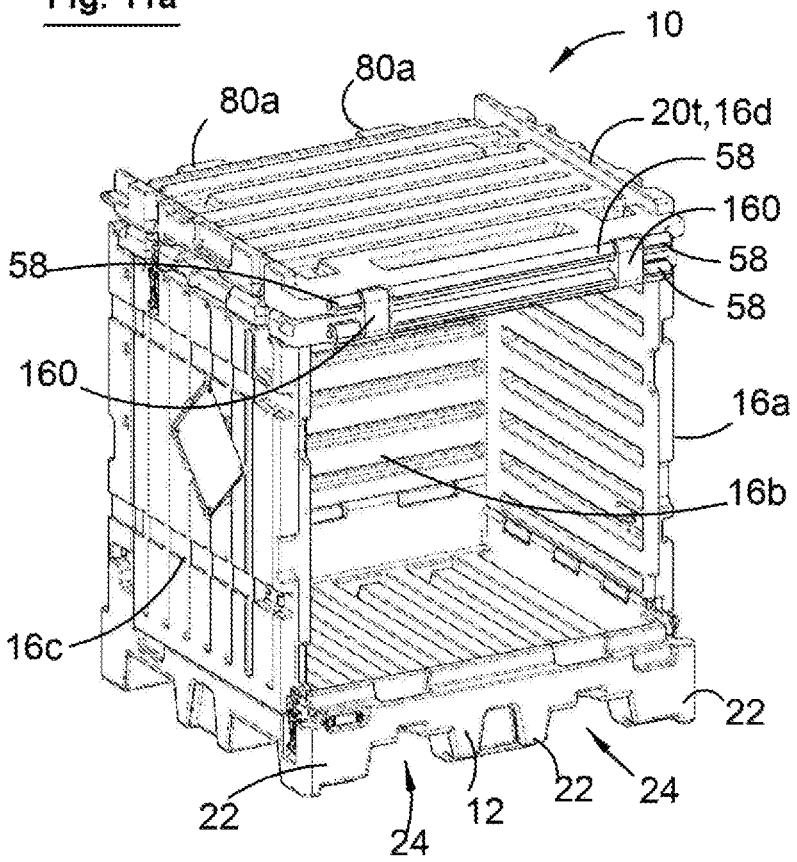
FIG. 11*b* is a schematic representation of the container shown in FIG. 11*a* but with its lid structure in the closed configuration.

Further, with reference to FIGS. 11*a* and 11*b*, by slight modification of the hinge arrangement coupling the lid panels 20*t* and 20*f* two different front load configurations are possible.

In FIGS. 11*a* and 11*b* each of the lid panels 20*t* and 20*f* is formed with hinge portions 58. However the hinge portions 58 do not interleave with each other, rather are disposed side by side. Two links 160 extend between the hinge portions 58 on the lid panels 20*t* and 20*f*. A hinge mechanism similar to hinge mechanism 96 can then be incorporated to decouple the lid panels 20*t* and 20*f* in the same manner as described hereinabove.

The first front load configuration possible via the hinge arrangement of FIG. 11*b* is identical to that as shown in FIG. 1*d*. However in a second front load configuration shown in FIG. 11*a* the front wall 16*d*/second lid panel 20*f* is pivoted through 270° to lie on top of the first lid panel 201 and parallel to the base wall 12. The second front load configuration enables a further container 10 to be stacked on top of the opened lid structure 18. The lid structure of the stacked container can be moved to either the first front load configuration shown in FIG. 1*d* or the second front load configuration shown in FIG. 11*a*. Now two containers 10 can be stacked on top of each other and can both be front loaded.

In a further modification of the embodiment shown in FIGS. 11*a* and 11*b* tabs 80*a* may be formed on sliders 99 so as to be slid into and out of the pockets 49. Additionally a recessed handle 101 can be formed in the front panel 16*d*. With these modifications and referring to FIG. 11*b* is now possible to fully remove the front panel 16*d* by releasing the hinge mechanism and sliding the slide tabs 99 upwardly disengaging the tabs 80*a* from the recesses 49. Assuming the latches 110 associated with panel 16*d* are disengaged a user can now simply pull off the front panel 16*d* using the handle 101. Resultant container will look like that shown in FIG. 11*a* but without the panel 16*d* lying on top of the panel 14.

Further, the bottom wall 12 is depicted as being provided with a plurality of channels 24 created by a matrix of spaced apart legs 22 in order to facilitate the lifting of the container 10 with a forklift truck. However this function can be equally achieved by modifying the bottom wall 12 in a manner so that the channels 24 are replaced with hollow box sections for receiving the forks of a forklift truck.

In yet a further variation with reference to the provision of a bladder 130 shown in FIG. 9 it is possible to form the top wall 14/lid panel 20*t* with a removable wall portion which overlies the inlet 132. In this way the bladder 130 can be accessed without opening the container 10. In such a variation the removable cover may also be provided with a latching mechanism to prevent unauthorised access to the bladder 130.

Also the hinge mechanism 96 can be configured in many different ways to produce the same effect. In one very simple alternative a single elongated shaft can be used to pass through the hinge portions 58 and 98 to create the pivot coupling between the top and front walls 14, 16*d*. A fixed stop can be provided at one end of the shaft and a releasable stop at the other end such as a nut, a split pin or cotter pin at the opposite end. This can be detached enabling the shaft to be remove thereby decoupling the top and front walls 14, 16*d* which in this the same as decoupling the first and second lid panels 20*t* and 20*f* form each other.

The configuration of the lid structure 18 enables the container 10 to comprise part of a materials handling system. This system would comprise one or more containers 10 and a number of additional front walls/second lid panels 16*d*/20*f*.

In this system the second lid panels 20*f* which would constitute the front wall of the container can be provided with visual indicia representative of a specific type of material contained in or to be received in the container 10. For example the indicia can be the colour of the panel 20*f*. Expanding on this example the colour:

Blue may be used to signify general and non-hazardous materials requiring no special handling regime Yellow may be used to signify used lead acid batteries Red may be used to signify used mixed dry cell batteries Green may be used to signify oil filters Orange may be used to signify used aerosol cans Grey may be used to signify liquid waste In this example the remaining walls/panels from which the container 10 is constructed may also be of the same colour. This colour can be for example the same colour used to signify general waste (i.e. in this case blue). Thus a materials handling company may have for example ten containers 10 with blue coloured second lid panels 20*t* and say twenty additional second lid panels 20*t*, four each coloured yellow, red, green, orange and gray. The company can simply interchange the second lid panels with one of the colour appropriate for the material to be carried or placed into the container 10.

Also each of the side and top walls can be provided with a signage holding arrangement enabling signs to the replaceable attached to the walls. In one simple example this can be two spaced apart rails fixed by rivets to the wall and into which signs can be slid.

In yet a further variation the latch mechanisms 112 shown in FIGS. 8*a* and 8*b* may be replaced with more sophisticated latch mechanism 200 shown in FIGS. 12*a*-19*c*.

Figure 12A:
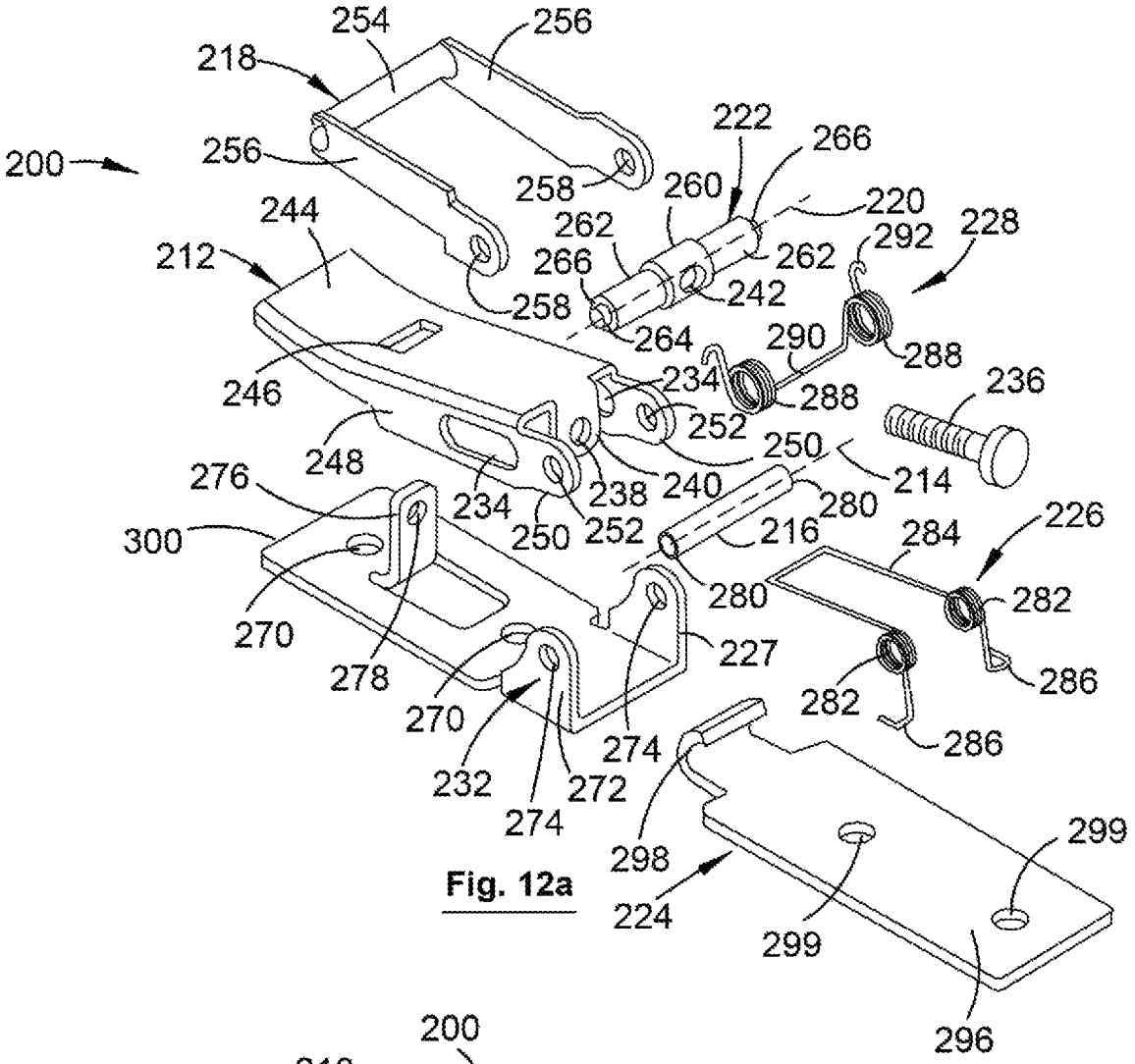
FIG. 12*a* is an exploded perspective view of the components of a second embodiment of the latch mechanism ("second latch mechanism")
Figure 12B:
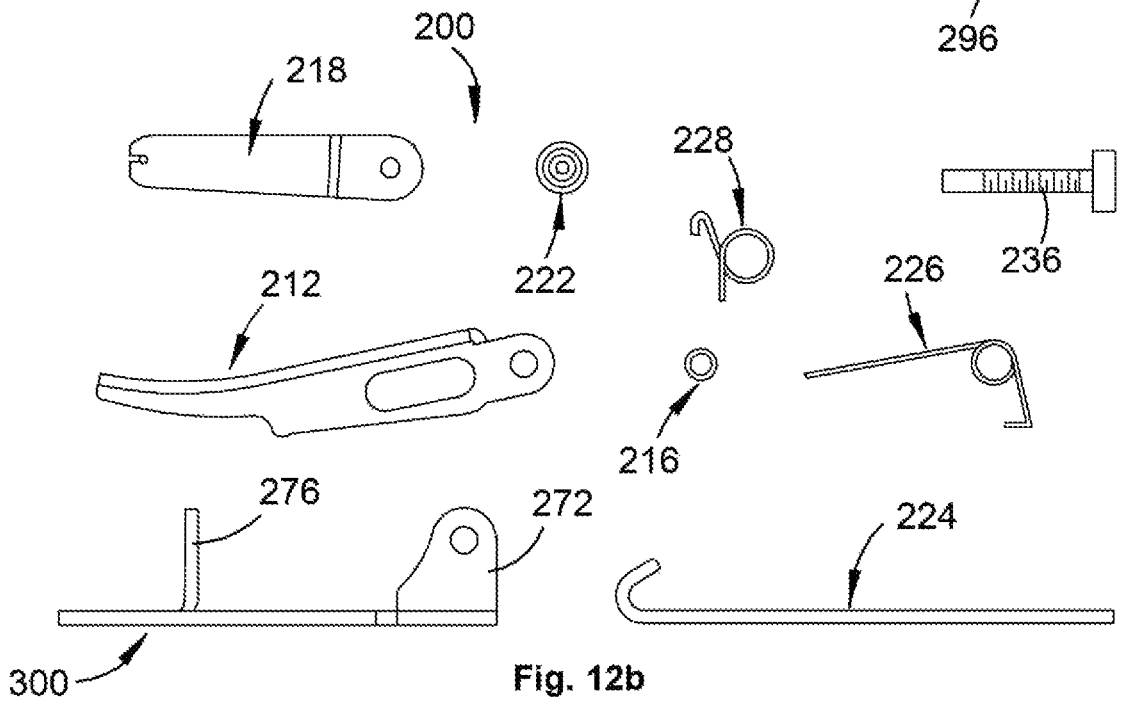
FIG. 12*b* is a side view of the components shown in FIG. 12*a;*

FIGS. 12 and 12*b* depict component parts of an embodiment of the disclosed latch mechanism 200. The latch mechanism 200 includes a lever 212 which is capable of pivotal movement about a lever axis 214. The lever axis 214 coincides with a central axis of a coupling pin 216. The latch mechanism 200 also includes a latch member 218 which is pivotally coupled about a latch axis 220 to the lever 212. The latch axis 220 coincides with a central axis of a coupling pin 222. As will be explained in greater detail below the latch member 218 can be moved by pivoting the lever 212 about the lever axis 214 so that the latch member 218 can engage a catch 224.

The lever 212 and the latch member 218 are biased to pivot in the same direction D1 about their respective axes 214 and 220. This bias is provided by way of a lever spring 226 and a latch spring 228. In this particular embodiment the latch mechanism 200 also comprises a bracket 300 which incorporates a base 232. The lever 212 is attached to the base 232 by way of the pin 216. The latch member 218 is coupled to the lever 212 by way of the coupling pin 222. The coupling pin 222 has opposite ends that ride in respective slots 234 on opposite side walls 248 of the lever 212. The coupling of the latch 218 to the lever 212 is completed by a screw 236 that passes through a hole 238 in a depending lug 240 of the lever 212. The screw 238 also engages a threaded hole 242 formed in the coupling pin 222. Therefore turning of the screw 236 causes the coupling pin 222 to slide along the slots 234.

Looking at the components of the latch mechanism 200 in more detail it will be seen that the lever 212 has an upper plate portion 244 formed with an opening 246. The side walls 248 extend downwardly from opposite edges of the plate 244. The slots 234 are formed in the side walls 248. The side walls 248 include planar projections 250 in which respective holes 252 are formed.

The latch member 218 is formed with a transverse bar 254 extending between arms 256. The arms 256 extends side by side and generally parallel to each other. A hole 258 is formed near and in-broad of an end of each arm 256 distant the bar 254.

The coupling pin 222 has a central cylindrical portion 260. Extending axially from opposite sides of the portion 260 are reduced diameter portions 262. The portions 262 ride in the slots 234. Extending axially from the portions 262 are respective reduced diameter stubs 264. The stubs 264 extend through the holes 258. In order to retain the coupling of the pin 222 to the latch member 218 once the stubs 264 have been passed through the holes 258 their respective free ends are pressed outwardly to form flanges 266 of a diameter of greater than that of the holes 258.

The bracket 300 is provided with a plurality of holes 270. The holes 270 can receive fasteners (not shown) for attaching the bracket 300 to an article. The bracket 300 includes or incorporates the base 232. The base 232 is in the form of two upright lugs 272 each of which is provided with a hole 274. The bracket 300 is also provided with an upright lug 276 formed with a hole 278.

The lever 212 is attached to the bracket 300 and in particular the base 232 away of the pin 216 which passes through the holes 250 and 274. During assembly the opposite ends of the pin 216 are flared outwardly to form respective flanges 280. The flanges 280 have a diameter greater than that of the holes 250 and 274. The lug 276 is located so as to pass through the opening 246 (as shown for example in FIGS. 13*a*, 14*a* and 17) when the lever 212 overlies the bracket 300.

The lever spring 226 comprises two coils 282 spaced apart by an integral U-shaped tongue 284. Each coil 282 is also formed within an integral hook arm 286. The route of the lever spring 226 is detailed in FIGS. 15*a*, 15*b* and 17. From these Figures, it will be seen that the coils 282 are located about the pin 216. The tongue 284 lies beneath and presses against an underside of the plate portion 244 of the lever 212. The hook arms 286 hook around the lugs 272. The spring 216 acts to bias the lever 212 in the first direction D1 (shown in FIGS. 18*c* and 19*c*). The direction D1 is a direction toward the bracket 300.

With particular reference to FIGS. 12*a*, 16*a*, 16*b* and 17, the latch spring 228 is formed with two coils 288 which are spaced apart by an integral link 290. The end of each coil 288 distant the link 290 is provided with a respective hook finger 292. In the assembled latch 200, the coils 288 reside on respective portions 262 of the pin 222, while the link 290 runs transversely across the lever 212 beneath the side walls 248. The hook fingers 292 hook about the arms 256 of the latch member 218. The latch spring 228 is configured to bias the latch member 218 to also pivot in the direction D1. By virtue of the aforementioned arrangement, the latch spring 228 acts between the latch member 218 and the lever 212.

Applying a force to pivot the lever 212 in a direction D2 which is opposite the direction D1 will increase the tension in the lever spring 226. However this will have no effect on the tension in the latch spring 228. In this manner the lever spring 226 and latch spring 228 operate independently of each other. Pivoting of the latch member 218 in the direction D2 relative to the lever 212 will increase the tension in the latch spring 228. Due to the relationship between the respective pivot axes 214 and 220, such action is also likely to create a moment about the axis 214 and provides some increase in tension in the lever spring 226.

The screw 236 can be turned in opposite directions to traverse the pin 222 along the slots 234 thereby allowing the position of the latch member 218 to be varied with respect to the lever 212. This is also manifested by an adjustment in the distance between the respective pivot axis 214 and 220.

Referring back to FIG. 12*a*, the catch 224 comprises a plate 296 which is turned or curled at one end to form a hook 298. A plurality of holes 299 is formed in the plate 296 to receive fasteners (not shown) for fixing the catch 224 to a second article (not shown).

Figure 13A:
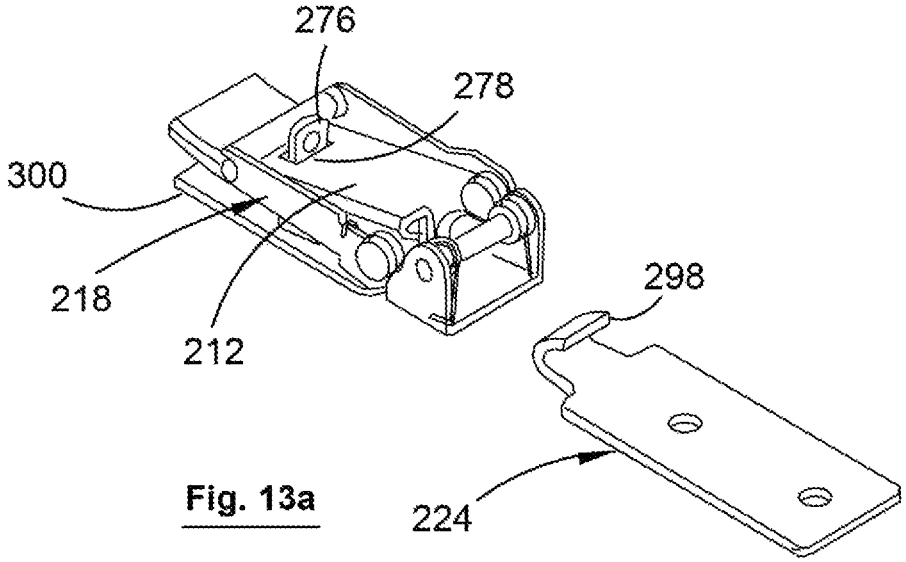
FIG. 13*a* is a perspective view of the second latch mechanism in a released position.
Figure 13B:
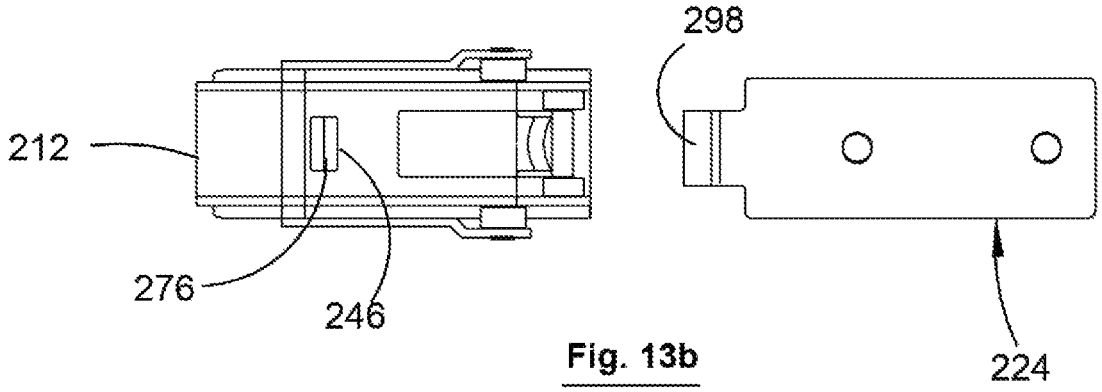
FIG. 13*b* is a top elevation of the second latch mechanism in the released position.
Figure 13C:
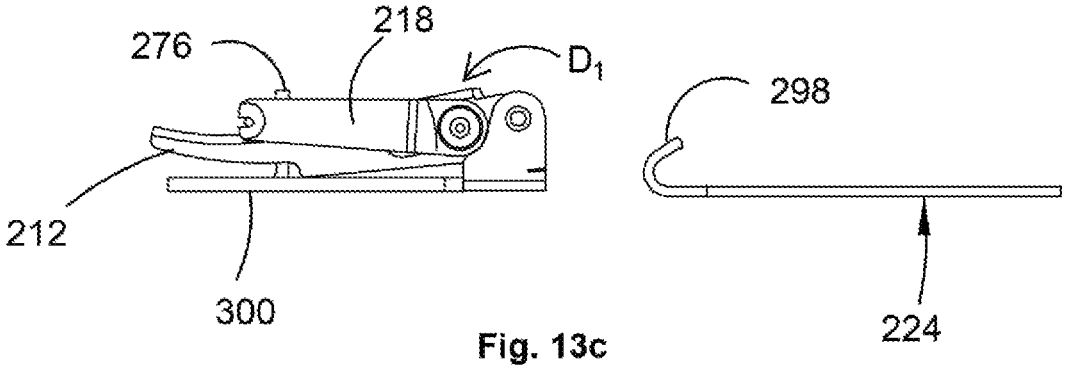
FIG. 13*c* is a side elevation of the second latch mechanism in the released position.

The FIGS. 13*a*-13*c* show the latch mechanism 200 in a released or unlatched position. In the released position:

- the lever 212 is biased by the lever spring 226 against, and overlies, the bracket 30;
- the latch member 218 is biased by latch spring 228 against and overlies the lever 212; and
- the lug 276 extends through the opening 246 in the lever 212.

The lever spring 226 and latch spring 228 are preloaded so that when the latch mechanism 200 is in the released position both springs are under tension biasing the lever 212 and the latch member 218 in the direction D1. As a result irrespective of the orientation of the article to which the latch mechanism 200 is attached the latch mechanism 218 bears against the lever 212 and the lever 212 bears against the bracket 300. This prevents the latch arm 218 and/or lever 212 from freely swinging about their respective axes. This is of practical benefit as neither the lever 212 nor the latch can swing out and potentially be accidentally run into to by a person to cause injury or hits by a piece of equipment and thus damaged or broken. Also in the released position the lever arm 218 is disengaged and spaced from the catch 224. Therefore the respective articles to which the bracket 300 and catch 224 are attached may be moved relative to each other.

Figure 14A:
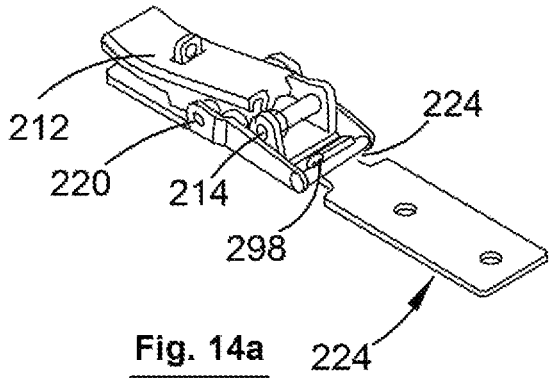
FIG. 14*a* is a perspective view of the second latch mechanism in the latched position.
Figure 14B:
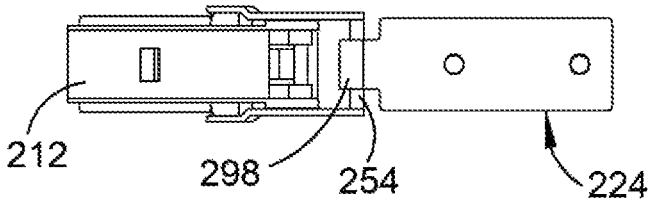
FIG. 14*b* is a top elevation of the second latch mechanism in the latched position.
Figure 14C:
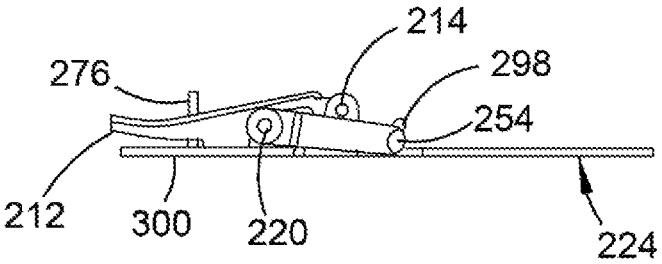
FIG. 14*c* is a side elevation of the second latch mechanism in the latched position.
Figure 15A:
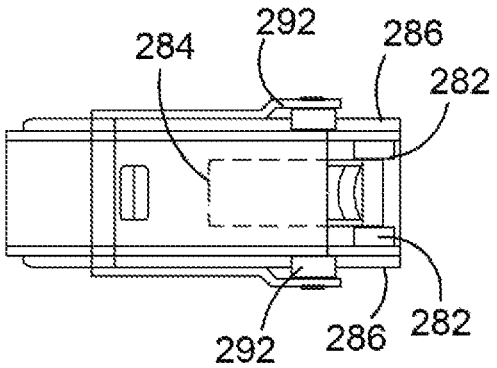
FIG. 15*a* is a top elevation of the second latch mechanism showing details of a lever spring incorporated in the latch mechanism.
Figure 16A:
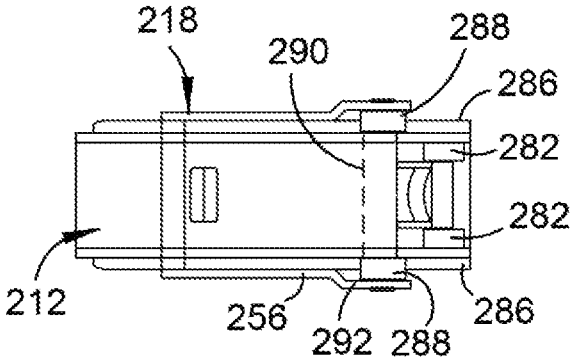
FIG. 16*a* is a top elevation showing details of a latch spring incorporated in the second latch mechanism.
Figure 15B:
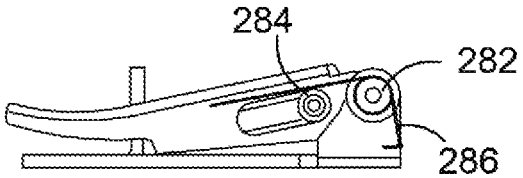
FIG. 15*b* is a side elevation showing details of the lever spring.
Figure 16B:
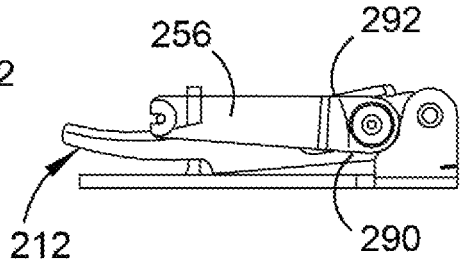
FIG. 16*b* is a side elevation of the second latch mechanism showing the latch spring.
Figure 17:
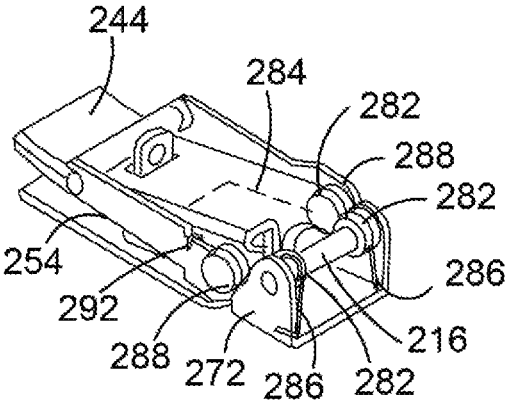
FIG. 17 is a perspective view of the second latch mechanism highlighting the spring route of both the lever spring and the latch spring shown in FIGS. 15*a*-16*b;*

FIGS. 14*a*-14*c* depict the latch mechanism 200 in the engaged or latched position. In this position:

- the latch member 218 is engaged with the catch 224, and more particularly the bar 254 is received within the curvature of the hook 298;
- the lever 212 is biased by the lever spring 224 against the bracket 300; the lug 276 protrudes through the opening 246 with the hole 278 also exposed above the lever 212.

The latch spring 228 is in its most tensed state and applies a moment to the lever 212 in the direction D2 about its pivot axis 214. However this does not result in the lever 212 pivoting in the direction to away from the bracket 300. In particular the spring 226 is arranged to have a bias which overcomes the moment applied by the latch spring 228 when the latch mechanism 200 is in the latched position. Additionally the effect of the moment applied by the latch spring 228 is reduced by the location of the pivot axis 220 being below the pivot axis 214.

The combination of the lug 276 and the opening 246 form a locking facility enabling the lever 212 to be locked against pivotal movement about its axis 214 at least to the extent that would result in the latch member 18 disengaging from the catch 224. This is achieved for example by coupling a padlock or other type of secure lock (not shown) to the lug 76 through the hole 78.

Figure 18A:
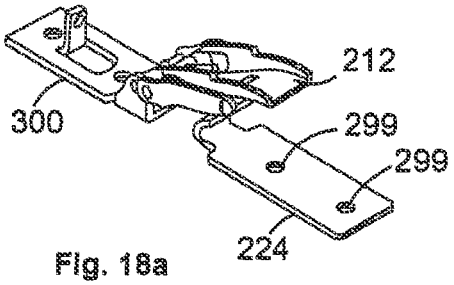
FIG. 18*a* is a perspective view of the second latch mechanism in a first intermediate position between the released and latched positions.
Figure 18B:
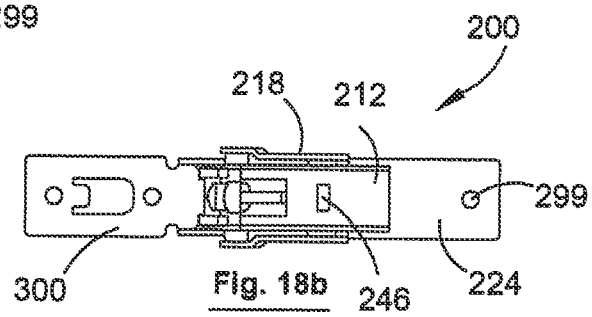
FIG. 18*b* is a top elevation of the second latch mechanism shown in FIG. 18*a;*
Figure 18C:
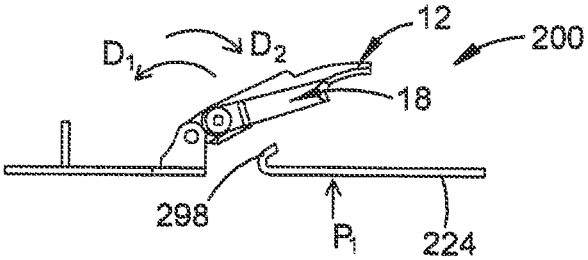
FIG. 18*c* is a side elevation of the second latch mechanism shown in FIG. 18*a;*

FIGS. 18*a*-18*c*; and 19*a*-19*c* illustrate two sequential intermediate positions of the latch member 200 moving from the released position to the latch position.

Starting with the latch mechanism 200 in the released position (shown in FIGS. 13*a*-13*c*) a force, for example by a person's thumb, is applied to the lever 212 causing it to pivot in the direction D2 about its pivot axis 214. This is against the direction of the bias applied by the lever spring 226. The latch member 218 is carried by the lever 212 so as to reach over the catch 224 and in particular the hook 298. From the position shown in FIG. 18*c* the user may either: (a) continue to pivot the lever 212 in the direction D2 so that the bar 254 will be located adjacent the catch 224 and in the vicinity of position P1; or (b) separately pivot the latch member 218 about its pivot axis 220 away from the lever 212 so that the bar 254 lies adjacent the catch 224 around the position P1. In either case it will be recognised that the latching mechanism 200 is not at this stage in the engaged position as the bar 254 is spaced from and not received within the hook 298.

Figure 19A:
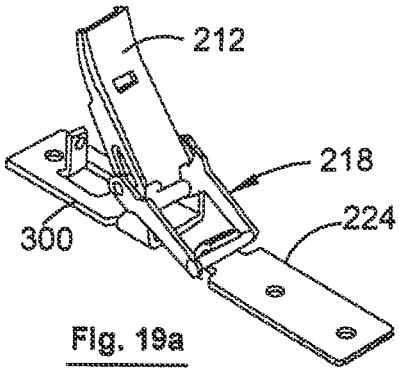
FIG. 19*a* is a perspective view of the second latch mechanism in a second intermediate position moving from the loose position to the latched position.
Figure 19B:
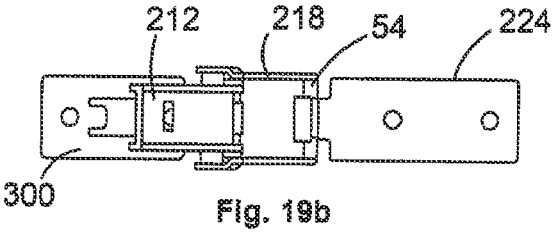
FIG. 19*b* is a top elevation of the second latch mechanism shown in FIG. 19*a*.
Figure 19C:
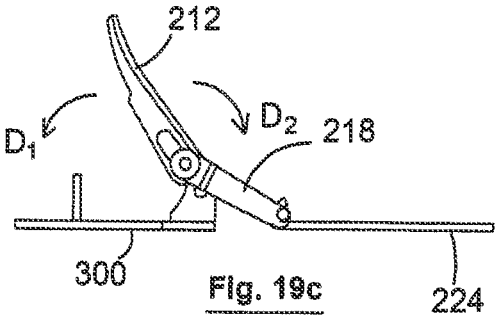
FIG. 19*c* is a side elevation of the second latch mechanism shown in FIG. 19*a*.

In order to effect engagement and place the latching mechanism 200 in the latched position the force applied to the lever 212 is steadily reduced or can be totally released while holding the latch member 218 against the catch 228. This will result in a translation of the latch member 218 and in particular the bar 254 toward and into engagement with the hook 298. This position is shown in FIGS. 19*a*-19*c*. If a user has not already released the lever 212 they may now do so and rely on the bias of the lever spring 226 and the over centre action of the lever mechanism 200 to pivot the lever 212 in the direction D1 towards the bracket 300. It should also be understood that this pivoting motion has the effect linearly displacing the bar 254, and thus pulling the catch 224, toward the base 232 and bracket 300. The degree of this pull can be adjusted by turning of the screw 236. This adjustment would be normally performed prior to the latching mechanism 200 being moved to the latched position.

In use the adjustment may be done by trial and error moving the latch mechanism to the intermediate position shown in FIGS. 19*a*-19*c* and feeling the degree of force required to push the lever arm 212 in the direction D1 so as to lie against the bracket 300 with the lug 276 extending through the opening 246. The degree of adjustment of spacing between the axis 214 and 220 is approximately equal to the length of the slot 234 minus the diameter of the arms 262.

Depending on this adjustment, the lever 212 may be able to return by action of the lever spring 226 only. However in order to tightly couple the latch arm 218 to the catch 224 it is envisaged that the adjustment will be such that the lever will pivot by action of the lever spring 226 alone only to a position where is it spaced above the bracket 300. In order for the lever 212 to be placed against the bracket 300 a force will need to be applied to snap the lever down onto the bracket 300. This also provides the pulling effect described above of the catch 224 towards the bracket 300.

In order to disengage the latch mechanism 200 (i.e. move it from the latched position to the released position) the user need only pivot the lever 212 in the direction D2 through an angle sufficient to slide the bar 254 out of the hook 298. At that time the bias of the latch spring 228 will automatically pivot the latch member 218 in the direction D1. The user may simultaneously release the force on the lever 212 which will result in the lever spring 226 pivoting the lever 212 in the direction D1 carrying with it the latch member 218. The lever 212 and latch member are thus returned to the released position shown in FIGS. 13*a*-13*c*.

The latch mechanism 200 may be embodied in other forms. For example the base 232 may be formed integrally with (i.e. moulded into or as part of) the various walls 16 much like hinge portions 58 to provide an anchor point for the lever 212 which can be coupled via the coupling pin 214. Similarly, the catch 224 and more specifically the hook 298 can be moulded into other walls 16 of the container 10.

In the claims which follow and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features of the container as disclosed herein.

The claims defining the invention are as follows:

1. A latch mechanism comprising:

a bracket;

a lever configured for pivotal movement about a lever axis relative to the bracket;

a latch member pivotally coupled about a latch axis to the lever, the latch member being configured to be moved by pivoting of the lever about the lever axis to reach and engage a catch;

a lever spring configured to bias the lever to pivot in a first direction about the lever axis; and a latch spring configured to bias the latch member to pivot in the first direction about the latch axis;

wherein the lever and the latch member are movable between a released position and a latched position, and, when in the latched position, the lever has pivoted about the lever axis in a second direction being opposite to the first direction and the latch member is configured for engaging the catch;

wherein, when in the released position:

the lever spring and latch spring are preloaded so that both the lever spring and the latch spring are under tension biasing the lever and the latch member in the first direction, the lever spring biases the lever in the first direction such that the lever bears against and overlies the bracket, the latch spring biases the latch member in the first direction such that the latch member bears against and overlies the lever, and the latch member and the lever are prevented from freely swinging about the latch axis and the lever axis, respectively; and when in the latched position, upon applying a force on the lever to pivot the lever through a first angle in the second direction, the latch member is displaced from the catch, and, on subsequent release of the force, both the lever and the latch member are biased to pivot in the first direction to the released position.

2. The latch mechanism according to claim 1, wherein the latch spring is configured to act between the lever and the latch member.

3. The latch mechanism according to claim 2, wherein the lever spring is configured to act between the lever and a base to which the lever is pivotally coupled.

4. The latch mechanism according to claim 1, wherein the lever spring and latch spring act independently of each other.

5. The latch mechanism according to claim 1 wherein the latch member is coupled to the lever in a manner to enable adjustment of a distance between the lever axis and the latch axis.

6. The latch mechanism according to claim 5, wherein the adjustment is affected by a screw configured to engage a threaded hole formed in a coupling pin which coincides with the latch axis.

7. The latch mechanism according to claim 1, further comprising a locking facility configured to enable the lever to be locked against pivotal movement to an extent to enable release of the latch member from an engaged catch.

8. The latch mechanism according to claim 7, wherein the locking facility comprises a lug and an opening in the lever, the lug and opening being juxtaposed such that the lug is able to extend through the opening when the lever is in a first state, and the lug being configured to receive a releasable locking device.

9. The latch mechanism according to claim 1, wherein the latch member comprises a transverse bar configured to engage the catch when the lever and the latch member are in the latched position, and to bear against the lever by the action of the latch spring when the lever and the latch member are in the released position.

10. The latch mechanism according to claim 9, wherein the latch member comprises parallel arms between which the transverse bar is configured to extend.

11. The latch mechanism according to claim 10, wherein the lever comprises an upper plate portion, and, when in the released position, the transverse bar is configured to be biased against the upper plate portion.

* * * * *